US012173715B2

(12) United States Patent
Roys

(10) Patent No.: US 12,173,715 B2
(45) Date of Patent: Dec. 24, 2024

(54) ADAPTIVE LUBRICATOR BOX

(71) Applicant: Curtis Alan Roys, Fredericksburg, TX (US)

(72) Inventor: Curtis Alan Roys, Fredericksburg, TX (US)

( * ) Notice: Subject to any disclaimer, the term of this patent is extended or adjusted under 35 U.S.C. 154(b) by 95 days.

(21) Appl. No.: 17/822,754

(22) Filed: Aug. 26, 2022

(65) Prior Publication Data

US 2023/0076021 A1 Mar. 9, 2023

Related U.S. Application Data

(63) Continuation of application No. 17/659,629, filed on Apr. 18, 2022, now abandoned, which is a continuation of application No. 17/457,892, filed on Dec. 6, 2021, now abandoned, which is a continuation of application No. 17/382,326, filed on Jul. 21, 2021, now abandoned, which is a continuation of application No. 17/141,090, filed on Jan. 4, 2021, now abandoned, which is a continuation of application No. 16/937,260, filed on Jul. 23, 2020, now abandoned.

(60) Provisional application No. 62/877,816, filed on Jul. 23, 2019.

(51) Int. Cl.
*F04C 29/02* (2006.01)

(52) U.S. Cl.
CPC ..... *F04C 29/023* (2013.01)

(58) Field of Classification Search
CPC ..... F04B 23/028; F04C 29/023
See application file for complete search history.

(56) References Cited

U.S. PATENT DOCUMENTS 4,108,577 A * 8/1978 Brucken ..... F04B 27/18 417/270
4,240,394 A * 12/1980 Lay ..... F01L 7/02 123/214
4,510,894 A * 4/1985 Williams ..... F02B 75/26 123/56.7
5,009,286 A * 4/1991 Ikeda ..... F04B 27/109 417/269
5,380,170 A * 1/1995 Fain ..... F04B 39/0261 418/55.6
5,835,372 A * 11/1998 Roys ..... G01F 3/16 73/239
6,823,270 B1 * 11/2004 Roys ..... G01F 15/063 702/45
6,850,849 B1 * 2/2005 Roys ..... G01F 15/063 702/45
7,096,889 B1 * 8/2006 Roys ..... F15B 13/0839 184/7.4
7,461,670 B1 * 12/2008 Roys ..... F16K 37/0041 137/554
7,806,235 B1 * 10/2010 Roys ..... F16N 13/02 184/26

(Continued)

*Primary Examiner* — Michael A Riegelman
(74) *Attorney, Agent, or Firm* — Michael Scheinberg; Scheinberg & Associates, PC

(57) ABSTRACT

A lubricator reservoir uses adapter components so that the lube box that can be mounted on any high speed compressors. The use of a single lubricator reservoir with adapters for different compressors enables reduced inventory and guarantees the owner/operator can always get their compressors up and running in a timely manner and reduce lost revenue.

9 Claims, 33 Drawing Sheets

(56) References Cited

U.S. PATENT DOCUMENTS

| | | | | |
|---|---|---|---|---|
| 2010/0101672 | A1* | 4/2010 | Roys | F16N 25/02 137/884 |
| 2014/0000983 | A1* | 1/2014 | Roys | F04B 39/0223 184/14 |
| 2015/0204248 | A1* | 7/2015 | Takeda | F16K 31/535 74/411 |
| 2015/0219276 | A1* | 8/2015 | Roys | F16N 25/02 137/565.33 |
| 2015/0226376 | A1* | 8/2015 | Roys | F16N 25/00 29/888.021 |
| 2016/0040663 | A1* | 2/2016 | Herman | F16K 15/042 137/15.19 |
| 2016/0040795 | A1* | 2/2016 | Roys | F16K 15/044 415/113 |
| 2016/0097486 | A1* | 4/2016 | Herman | F16N 23/00 184/6 |
| 2020/0003107 | A1* | 1/2020 | Onodera | F02F 1/243 |
| 2023/0076021 | A1* | 3/2023 | Roys | F04B 23/028 |
| 2023/0349471 | A1* | 11/2023 | Roys | F16K 17/0406 |

* cited by examiner

SECTION A-A

ADAPTIVE LUBRICATOR BOX

This application is a continuation of U.S. patent application Ser. No. 17/659,629, filed Apr. 18, 2022, which is a continuation of U.S. patent application Ser. No. 17/457,892, filed Dec. 6, 2021, which is a continuation of U.S. patent application Ser. No. 17/382,326, filed on Jul. 21, 2021, which is a continuation of U.S. patent application Ser. No. 17/141,090 filed on Jan. 4, 2021, which is a continuation of U.S. Ser. No. 16/937,260, filed on Jul. 23, 2020, which claims priority from U.S. Provisional Pat. App. No. 62/877,816, filed on Jul. 23, 2019, and all of which are hereby incorporated by reference in their entirety for all purposes.

TECHNICAL FIELD OF THE INVENTION

The present invention relates to lubrication systems for natural gas compressors.

BACKGROUND OF THE INVENTION

History of Gas Compressor Lubricator Reservoirs:

Since the compressor industry began utilizing external pumps with lubrication reservoirs to supply lubricant to high pressure compressor cylinders and rod packing glands, each lubricator reservoir (herein termed "lube box"), was custom designed and manufactured specifically for an individual compressor or reciprocating pump application. This customization was necessary because the size of the cylinders and speed of the compressor dictated the quantity of oil needed to lubricate the cylinders and rod packing efficiently. The compressor frames were also designed and manufactured for compressors operating at specific RPM ranges and this dictated the use of different gear reductions in the lubricator reservoirs. The lube box serves not only as a reservoir for lubricant, but also transfers power from the compressor to the lubricator pump or pumps, which are typically mounted on the lube box. A shaft driven by a gear in the compressor typically extends from within the compressor into the lube box, being supported at both ends of the lube box by bushings in which the shaft rotates. The terms "oil" and "lubricant" are used interchangeably herein.

There are several reciprocating compressor manufacturers worldwide, and every compressor manufacturer designs their compressor to use different rotating drive assemblies to drive the lube box. The arrangement of the compressor, such as the position of the lube box mounting holes relative to the shaft and the diameter and extension of the shaft that drives the lube box, are different for different compressor manufacturers. Each lube box can, therefore, only be used on the specific compressor frame for which it was designed. No two compressors from different manufacturers can use the same lube box.

Because each compressor manufacturer requires a different lube box, there are several hundred models of lube boxes worldwide. Companies that distribute and service the lube boxes must stock an enormous quantity of inventory to be able to service their customers that required a new lube box when one fails in the field. This equates to tens of thousands of dollars in inventory needed to supply customers with the correct lube box in a timely manner. When a particular lube box is out of stock at a service company, it typically takes 8 to 10 weeks for the manufacturer to deliver a new lube box. A compressor owner/operator who cannot put its compressor back into service because they are waiting for a new lube box is suffering a loss of revenue due to lost gas production.

There is no lube box currently available in the compressor industry that can be repaired on-site while on the compressor frame in the field. Therefore, when a gas compressor must be shut down due to a faulty lube box, the lube box must be removed from the compressor frame and taken it to a qualified repair shop. In most cases, a repair shop will be several hours away from where the compressor is located, and qualified repair shops are typically unable to repair a lube box the same day it is brought into the shop. The owner/operator typically must purchase a new lube box to replace the defective unit, so they can get their compressor back in service and compressing gas. This presumes that the repair shop has a like-for-like lube box replacement in stock, which is not always the case.

When a natural gas compressor is not functioning, natural gas is still emitted by the well. It is typically burned as it is released into the atmosphere, a process known as "flaring." The Environmental Defense Fund released an analysis of gas flared in the Permian Basin area and the Eagle Ford area in the state of Texas the year of 2017. The S&P Global Market Intelligence used satellite image data from National Oceanic and Atmospheric Administration and estimated that the volume of gas flared into the atmosphere in the Permian basin and the Eagle Ford area due to compressors having to be shutdown was a much as 104 BCF (Billion Cubic Feet of gas). This represents an economic loss of approximately $322 million. In Texas, compressor owner/operators must pay royalties on extracted gas to University Lands, which manages gas leases, and these royalties must be paid even on gas that is flared. This cost is a major loss of revenue for the compressor owner/operators.

Given this expense, it is clear that it is desirable for owner/operators of gas compressors worldwide to be able to replace or repair a gas compressor lube box on site, and in a timely manner.

Another problem with prior art lube boxes is that the number of lubricator pumps powered by the lube box is fixed and cannot be changed. The shaft from the compressor typically drives a cam shaft that includes cams that drive hinged rocker arms that raise and lower pushrods to operate the lubrication pump. Each lubricator pump has an offset rotating cam to push the piston up and down. This action pulls the oil into the oil pump when the cam is in its lowest position and discharges the oil when the camshaft is in the highest position. The number of cams in the lube box dictates the number of pumps that can be installed in the lube box. If there are not enough lube pumps to supply the volume of oil needed to properly lubricate the compressor cylinders, rings, rods and packing glands, a new lube box with the ability to accommodate more lubricator pumps must be purchased and installed on the compressor.

It is sometimes desirable to diagnose a compressor to determine whether or not it has any defects. To enable the use of the diagnostic equipment, a lube box must be special ordered with a drive shaft that extends through the lube box to outside of the side opposite to the compressor. This not only adds cost to the industry standard lube boxes, but there are only two current lube boxes than are manufactured with the drive shaft extending through the reservoir, and special ordered lube boxes typically take a minimum of 8 to 10 weeks from time they're ordered to the time the customer receives them.

Another problem with current lube boxes is leaks—shaft seals fail and oil leaks from the lube box. Rising oil and atmospheric temperatures cause pressure to increase inside the lube box. The rising pressure inside the lube box causes oil seals to fail and oil to leak to the atmosphere causing environmental pollution and causing low oil levels in the lube box, which can cause gears and lube pumps to fail.

Another problem with prior art lube boxes is that the standard lube box currently available in the compressor industry is not waterproof. This is due to the way the components of the lube box are designed and type of gaskets used to seal the top cover of the lube box to the box itself. The gaskets used to seal the lubricator pumps to the top of the lube box do not form a watertight seal and cannot prevent water from entering the reservoir under heavy rainstorm conditions or high pressure washing, which is needed to clean the compressor frame. Water and debris contaminate the lubricating oil in the lube box which causes the components to wear and fail prematurely. The same debris in the lube box also causes the lubricator pumps to wear or fail prematurely.

SUMMARY OF THE INVENTION

An object of the invention is to provide an improved lube box and a method of making and using an improved lube box.

In some embodiments, the improved lube box can be adapted to function with different compressors.

In some embodiments, the adaptive lube box, drive assemblies and rotating drive adapters, are preferably engineered as a single stand-alone lube box that can be mounted on a wide variety of OEM compressors. Having a single lube-box design enables reduces required inventory and guarantees the owner/operator can always get their compressors up and running in a timely manner, reducing lost revenue.

In some embodiments, the lube box is adaptable to change the number of lubricator pumps attached thereto. In some embodiments, the lube box enables the use of a compressor diagnostic tool by facilitating the substitution of a longer drive shaft use for the normal operating drive shaft. In some embodiments, the lube box is resistant to oil leaks and seal failures. In some embodiments, the lube box has a watertight seal to prevent water and debris from entering the lube box.

The foregoing has outlined rather broadly the features and technical advantages of the present invention in order that the detailed description of the invention that follows may be better understood. Additional features and advantages of the invention will be described hereinafter. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more thorough understanding of the present invention, and advantages thereof, reference is now made to the following descriptions taken in conjunction with the accompanying drawings, in which.

DETAILED DESCRIPTION OF PREFERRED EMBODIMENTS

Figure 1A:
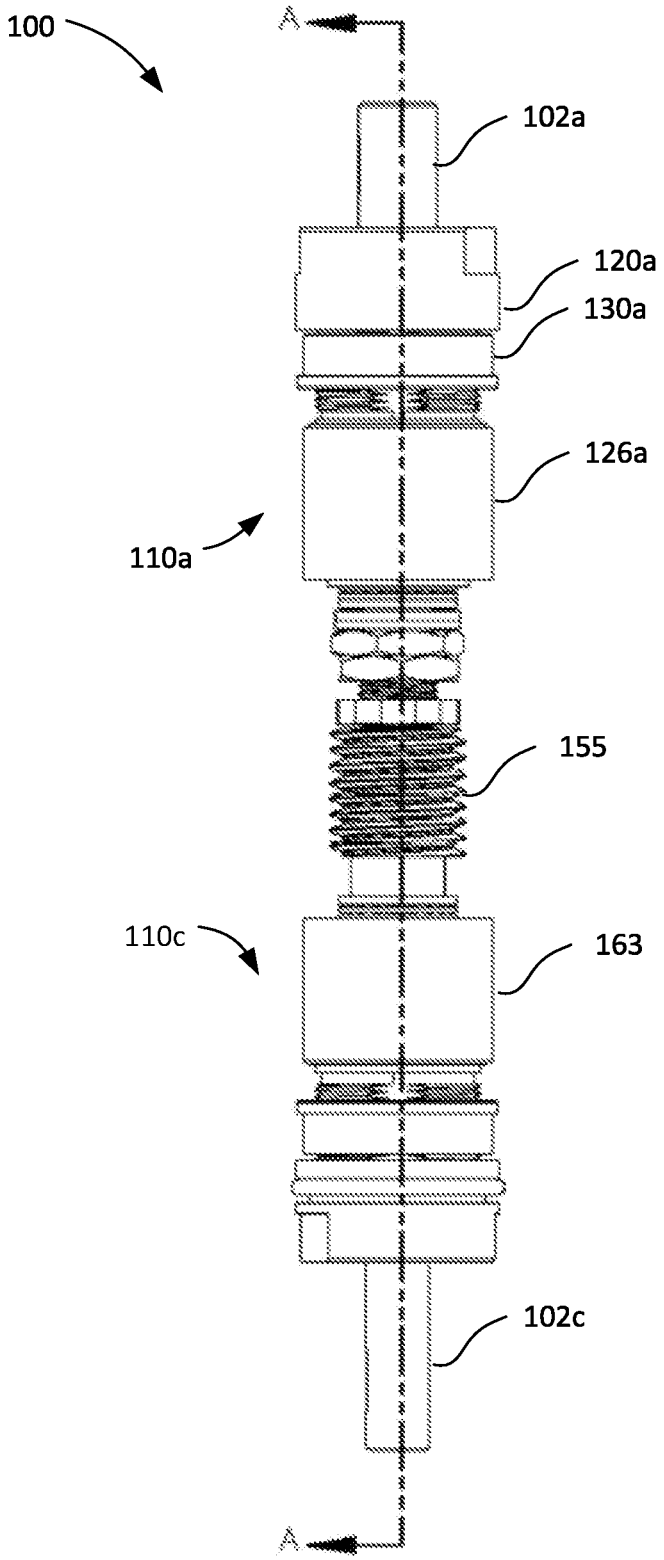
FIG. 1A shows a three-part drive shaft and FIGS. 1B and 1C show enlarged cross-sectional views of portions of the three-part shaft of FIG. 1A.

A lube box as described herein can be adapted to different types of compressors and pumps. A lube box typically includes a lube box housing or enclosure, a drive shaft that extends from the enclosure to be driven by the lubricated compressor, a cam shaft which is driven by the drive shaft and which turns the rotary motion of the drive shaft into reciprocating motion to operate one or more pumps through rods driven by cams on the camshaft, and one or more pumps.

The drive shaft is preferably constructed of multiple, separable segments, typically three segments. The end segment of the drive shaft that extends out of the lubricator reservoir and mates with the compressor can be selected from a set of end segments, each end segment adapted to mate with a different model of compressor. Besides allowing the lube drive shaft to mate with different types of compressors, the multiple separable segments of the drive shaft also facilitate servicing of the lube box in the field. The lube box can be serviced without requiring the lube box to be removed from the compressor, thereby eliminating the time required to remove the lube box from the compressor and bring the lube box to a service department for repair or replacement.

A lube box system incorporates a set of quick change mounting adapter components, including for example, adapter plates, spacers, shaft adapters, and fasteners. The sets of quick change mounting adapter components, each specific to a particular model of compressor, allows the lube box to be mounted on a variety of compressor models. The set of quick change mounting adapter plates gives the operator, mechanic, or product distributor the ability to select an appropriate set of quick change mounting components to mate the lube box to any reciprocating compressor frame. The adapter plates and spacers position the lube box relative to the compressor housing so that the drive shaft of the lubricator reservoir is aligned with the drive mechanism of the compressor, and the thickness of the adapter plate and spacers positions the lube box the required distance from the compressor housing. Other types of hardware can also be included in the quick change mounting adapter components.

Some lube boxes in accordance with this disclosure are modular in design, such that an extra oil compartment and camshaft with additional cams can be added or removed from an existing lube box. This modularity facilitates the addition of extra lubricator pumps, which allows the combined output of oil to be increased or decreased if an increase or decrease is required due to an increase or decrease in the volume of oil required to lubricate the compressor components. Modularity eliminates the need to purchase a completely new lube box if additional or fewer pumps are required.

Some embodiments of the lube box use an external oil level indicator that overcomes the problems of prior art sight glasses, which can be obscured by dirty oil.

Some embodiments of the lube box are waterproof, typically using O-rings that are compressed on assembly and using blind fasteners to reduce openings that can allow water or debris to enter into the lube box.

Some embodiments of the lube box use a top plate that allows the lube box to be rotated 180 degrees, allowing the lube box to fit compressors that require the drive shaft to come into the lube box from either side.

The lube box reservoir, drive assemblies, and rotating drive adapters, are preferably engineered to utilize a single lube box that can be mounted with an appropriate quick change mounting adapter hardware and drive shaft end segment onto all currently manufactured OEM high speed compressors. Using a single lube box enables reduces inventory and guarantees the owner/operator can always get their compressors up and running in a timely manner, thereby reducing lost revenue. As additional models of high speed compressors are introduced by manufacturers, additional adaptive quick change components and drive shaft end segments can be created by following the example described herein to adapt the lube box to new compressor models.

Three-Part Drive Shaft

One aspect of some preferred embodiment is a multi-part shaft design, which lets the shaft be readily adapted to different compressors. FIG. 1A shows a three-part shaft 100 and FIGS. 1B and 1C show enlarged cross sections of the shaft of FIG. 1A taken along lines A-A, with FIG. 1B showing the distal portion of the drive shaft furthest from the compressor and FIG. 1C showing the proximal portion of the drive shaft nearest the compressor.

Three part drive shaft 100 includes a distal shaft segment assembly 102*a*, a center shaft segment assembly 102*b*, and a proximal end shaft segment assembly 102*c*, which is nearest the compressor (not shown), and which is also referred to as a drive shaft adapter, because it is used to adapt the drive shaft 100 to the compressor. Both the distal shaft segment assembly 102*a* and the proximal end shaft end segment assembly 102*c* are sometimes referred to "drive shaft adapters" because they adapt the drive shaft to different compressors. Distal shaft segment assembly 102*a* has a first end 104*a* that can extend to near the wall of the lube box (nor shown) or to the outside of the lube box and an interior end 106*a* positioned within the lube box. Proximal shaft segment assembly 102*c* has a first end portion 104*c* that extends outside of the lube box (nor shown) and an interior end portion 106*c* positioned within the lube box. Each of distal shaft segment assembly 102*a*, center shaft segment assembly 102*b*, and proximal end shaft end segment assembly 102*c* are preferably supported by two bearings, one near each end of the shaft segment. Mating structures on the ends of the center shaft segment assembly 102*b* mates with a complementary mating structure on the interior ends of distal shaft segment assembly 102*a* and proximal shaft segment assembly 102*c*. For example, middle shaft segment can include rectangular key or protrusion at each end, and distal and proximal shaft segments 102*a* and 102*c* can include a mating slot at their internal ends.

Either of the first portions 104*a* and 104*c* can be connected to a compressor and first portions 104*a* and 104*c* may have different diameters to accommodate different models of compressors. Either of the first end shaft 102*a* or 102*c* can be removed from the three-part shaft 100 and can be replaced with an end shaft segment having a different diameter or a different length to fit with a different model of compressor.

Figure 1B:
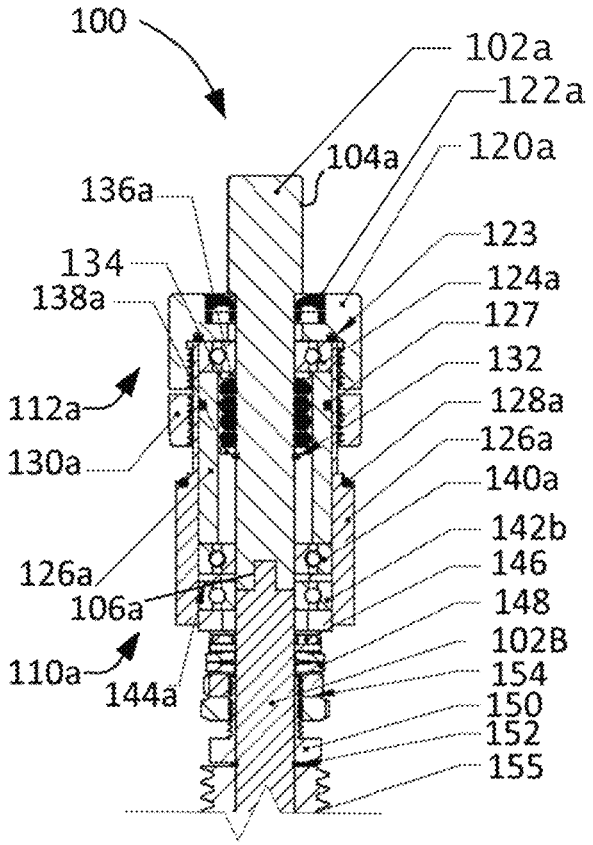
Figure 1C:
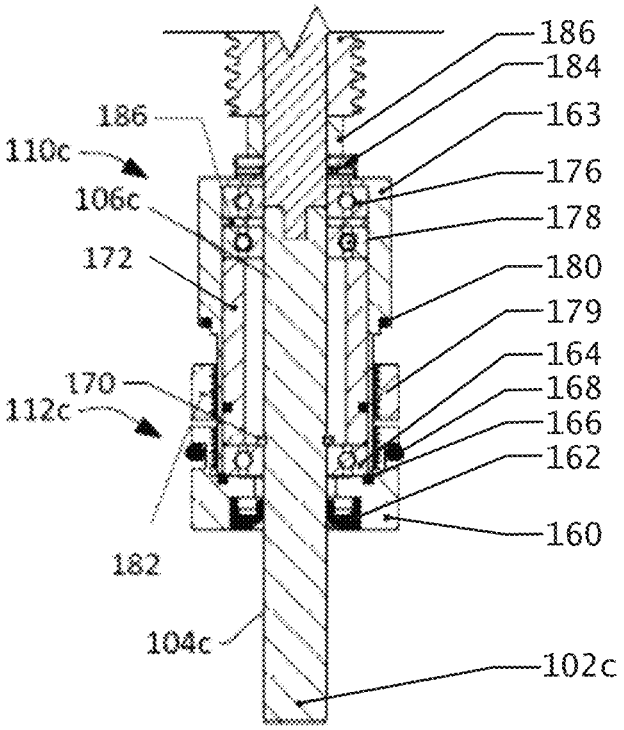

FIGS. 1A and 1B show a distal seal-bearing assembly 110*a* that houses seals and bearings that support distal shaft portion 102*a* and bearings that supports a first end of center shaft segment assembly 102*b*. FIGS. 1A and 1C show a proximal seal-bearing assembly 110*c* that houses seals and bearings that support proximal shaft portion 102*c* and bearings that support a second end of center shaft segment assembly 102*b*.

Proximal seal-bearing assembly 110*c* seals the housing of the lube box while allowing shaft end 104*c* to extend form the lube box, preventing lubricant from leaking from the lube box and preventing water and other contaminants from entering the lube box. Distal seal-bearing assembly 110*a* seals the housing of the lube box while allowing shaft end 104*a* to extend form the lube box, preventing lubricant from leaking from the lube box and preventing water and other contaminants from entering the lube box. In some embodiments, distal shaft 102*a* does not extend outside the lube box. In such embodiments, a cap (not shown) can be used to seal the end of the lube box. A portion of distal seal-bearing assembly 110*a* is conveniently referred to as end portion 112*a*, which comprises, in this example, components from the shaft adapter bearing housing 120*a* up to retaining ring 132, excluding lock ring 130*a*. Distal seal-bearing assembly end portion 112*a* may be customized for the type of compressor to which the lube box is attached.

Distal seal-bearing assembly 110*a* includes a shaft adapter bearing housing 120*a* that encloses a shaft seal 122*a* that provides a seal around shaft segment assembly 102*a*, preventing lubrication from leaking out of the lube box and preventing contaminants and water from leaking into the lube box. Shaft segment assembly 102*a* includes a diameter change or step that acts as a stop to limit the insertion of shaft segment assembly 102*a* into shaft adapter bearing housing 120*a*. Shaft adapter bearing housing 120*a* also secures a bearing 124*a*, preferably a roller bearing, that supports and provides low friction rotation to shaft segment assembly 102*a*. An O-ring 123 seals the space between bearing 124*a* and shaft adapter bearing housing 120*a*. Bearing 124*a* is secured between a spacer 125*a* and the shaft adapter bearing housing 120*a*, with an O-ring 127 sealing between the spacer 125*a* and shaft adapter bearing housing 120. A rear bearing housing 126*a* is threaded into the shaft bearing adapter 120*a* and secures the distal seal-bearing assembly 110*a* into the lube box housing, which is sealed by an O-ring seal 128. A lock ring 130*a* can be used to tighten the distal seal-bearing assembly 110*a* against the lube box housing. A portion of proximal seal-bearing assembly 110*c* is conveniently referred to as end portion 112*c*, which comprises, in this example, components from the shaft adapter bearing housing 120*c* up to retaining ring 170, excluding lock ring 182. Proximal seal-bearing assembly end portion 112*c* may be customized for the type of compressor to which the lube box is attached.

While the terminology "proximal" and "distal" refers to the position of the portion of the three-part shaft assembly relative to the compressor, the shaft is reversable and either side can be mated to the compressor.

In some compressors, the shaft is subject to longitudinal motion which can cause failure of the seal between the shaft and the lube box. Some embodiments reduce the longitudinal motion by providing multiple (in this embodiment shown, 4) shock mount O-rings 134 positioned between a retaining ring 132 on shaft segment assembly 102*a*. Thrust washers 136*a* and 138*a* on either side of the shock mount O-rings 134 absorb longitudinal motion of the shaft and that absorb the provide the seal between lube box to fail.

Rear bearing housing 126*a* supports a bearing 140*a*, preferably a roller bearing, that supports and provides low friction rotation to shaft segment assembly 102*a*. Another bearing 142*a* supported by rear bearing housing 126*a* and separated from bearing 140*a* by bearing spacer 144*a* supports and provides low friction rotation to center shaft segment assembly 102*b*. A thrust bearing 146 and two Bellville washers 148 absorb longitudinal motion.

A jack screw 150 supported by a retaining ring 152 supports two locking nuts 154 that remove slack by adjusting the positions of the components between the jack screw 150 and the shaft adapter bearing housing. A worm 155 positioned over middle segment assembly 102*b* drives a gear on a pump camshaft (not shown in FIG. 1*a*-1*c*).

A proximal seal-bearing assembly 110*c* supports and seals proximal shaft segment assembly 102*c*. The details of proximal seal-bearing assembly 110*c* vary with the compressor to which the lube box is attached. FIG. 1 shows one example.

A proximal shaft adapter bearing housing 160 supports an external O-ring and a shaft seal 162 that seals around proximal shaft segment assembly 102*c* to prevent lubricant from leaking. A front bearing housing 163 is threaded into proximal shaft adapter bearing housing 160. Proximal shaft adapter bearing housing 160 supports a bearing 164 that supports and provides low friction rotation to middle shaft segment assembly 102*c*. An O-ring seal 166 seals between bearing 164 and proximal shaft adapter bearing housing 160. An external O-ring 168 seals against a portion of the compressor (not shown) or adapter plate (not shown). A retaining ring 170 acts as a stop for the positioning of bearing 164. Separated from bearing 164 by a spacer 172 is a bearing 176 that supports center shaft portion 120*b* and a bearing 178 that supports proximal shaft segment assembly 102*c*. A bearing spacer 186 separates bearings 176 and bearing 178. An O-ring 179 seals between spacer 172 and front bearing housing 163. Lube box is sandwiched front bearing housing 163 and shaft adapter bearing housing 160. O-ring seal 180 provides a seal with the lube box housing. A lock ring 180 locks the relative position of front bearing housing 163 and shaft adapter bearing housing 160.

Between front bearing housing 163 and worm 154 is a thrust bearing 184 and a spacer 186. The Adaptive Lube box incorporates a totally redesigned rotating drive shaft that incorporates an "Adaptive Quick-Change Drive Assembly". This totally redesigned rotating drive assembly gives the operator, mechanic, or product distributor the ability change drive assemblies on the lubricator reservoir, to match any compressor frame rotating drive and in a matter of minutes.

FIGS. 2A, 2B, 2C, 3A, 3B, and 4A and 4B show a few examples of drive shaft adapters (proximal end segment assemblies) that include a shaft and a seal-bearing assembly end portions. One end of each shaft is configured to mate with a specific compressor, and the other end of each shaft is configured to mate with center drive shaft segment assembly 102*b* (FIGS. 1A and 1B). The drive shaft adapters of FIGS. 2A-4B are provided as examples, and skilled persons will be able to design drive shaft adapter for any compressor.

Figure 2A:
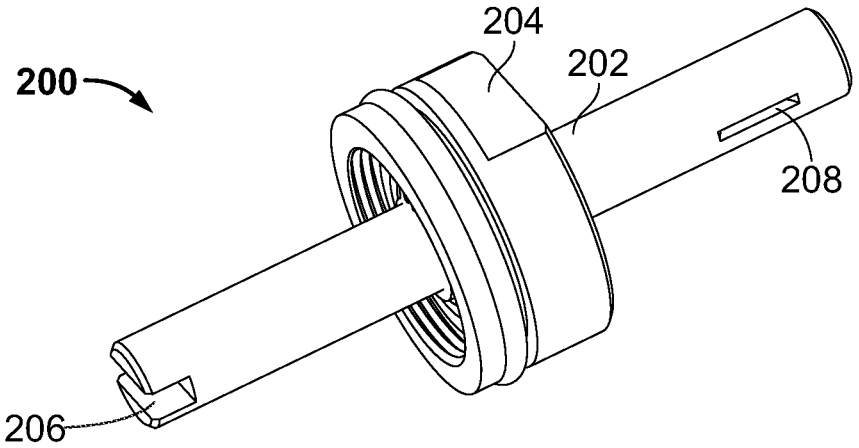
FIG. 2A shows an isometric view of a drive shaft adapter for an Ariel compressor using a ½ inch drive shaft.
Figure 2B:
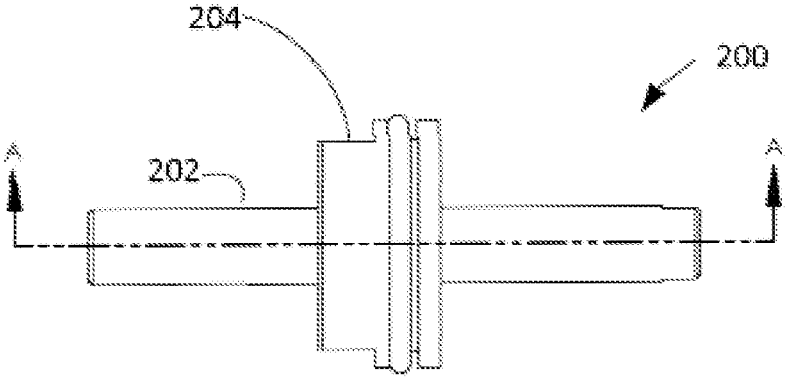
FIG. 2B shows a front view of the drive shaft of FIG. 2A.
Figure 2C:
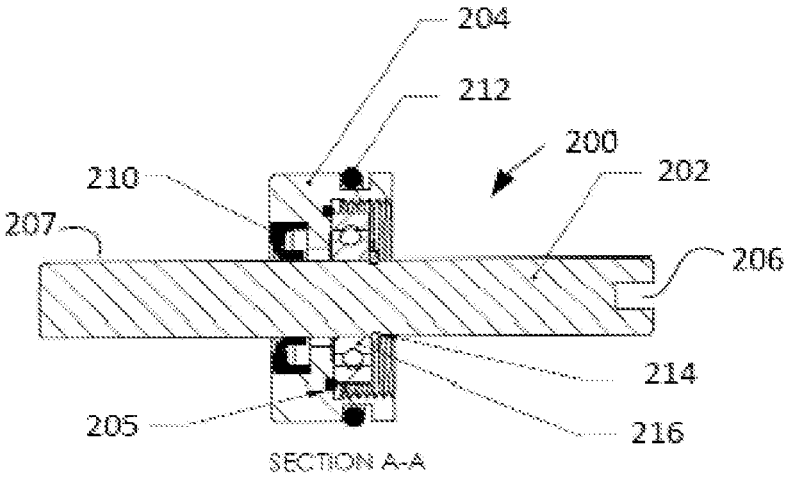
FIG. 2C shows a cross-sectional view of the drive shaft adapter of FIG. 2A.

FIG. 2A shows an isometric view of a drive shaft adapter 200 for an Ariel compressor using a ½ inch drive shaft. FIG. 2B shows a front view of the drive shaft adapter 200 and FIG. 2C shows a cross section of drive shaft adapter 200 taken along line A-A of FIG. 2B. Drive shaft adapter 200 comprises a proximal shaft segment 202 and a bearing housing 204. Proximal shaft segment 202 includes a key slot 206 that matches with the key in the center drive shaft segment assembly 102*b* (FIG. 1C) and a key slot 208 by which a compressor (not shown) can drive proximal shaft segment 202.

The bearing housing 204 screws onto a threaded portion of front bearing housing 163 (FIG. 1) and an O-ring 205 seals the connection between bearing housing 204 and front bearing housing 163. A shaft seal 210 seals the proximal shaft segment 202 and an external O-ring seal 212 seals against a portion of the compressor (not shown) or adapter plate (not shown). An external retaining ring 214 maintains a bearing 216 that supports rotation of the shaft segment 202.

Figure 3A:
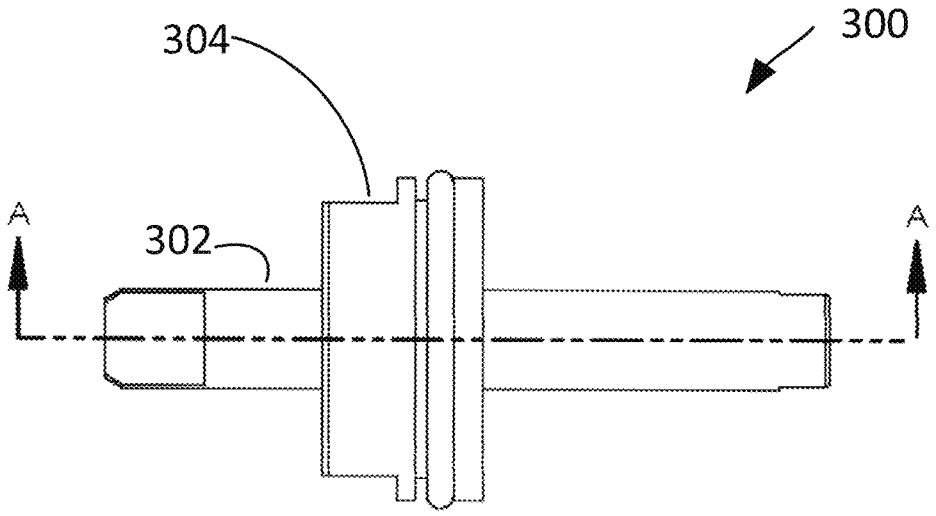
FIG. 3A shows a front view of a drive shaft adaptor for a 300 for a Dresser Rand compressor and FIG. 3B shows a cross-sectional view of the drive shaft adapter of FIG. 3A.
Figure 3B:
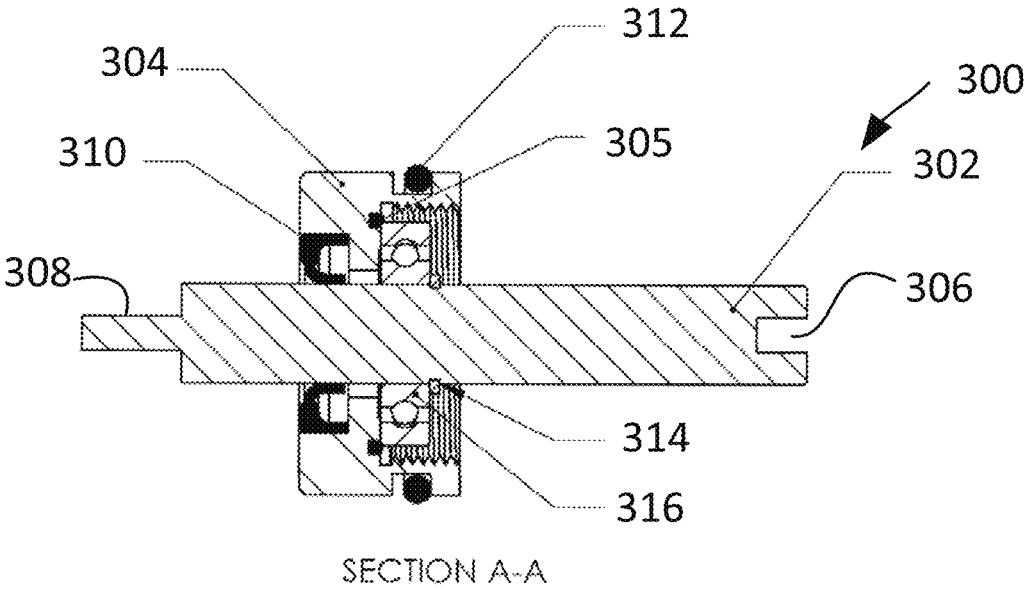

FIG. 3A shows a front view of a drive shaft adapter 300 for a Dresser Rand compressor. Drive shaft adapter 300 comprises a proximal shaft segment 302 and a bearing housing 304. Proximal shaft segment 302 includes a slot 306 that matches with the key in the center drive shaft segment assembly 102*b* (FIG. 1B) and a tang 308 by which a compressor (not shown) can drive proximal shaft segment 302. FIG. 3B shows a cross section of drive shaft adapter 300 taken along line A-A of FIG. 1A.

The bearing housing 304 screws onto a threaded portion of front bearing housing 163 (FIG. 1) and an O-ring 305 seals the connection between bearing housing 204 and front bearing housing 363. A shaft seal 310 seals the proximal shaft segment 302 and an external O-ring seal 312 seals against a portion of the compressor (not shown) or adapter plate (not shown). An external retaining ring 314 maintains a bearing 316 that supports rotation of the shaft segment 302.

Figure 4A:
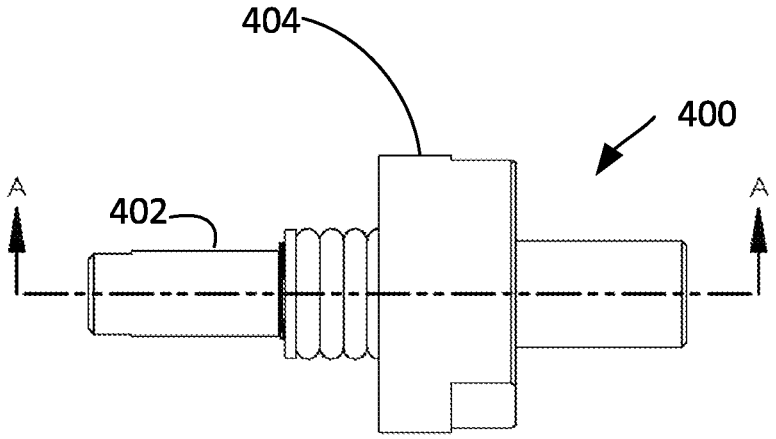
FIG. 4A shows a front view of a drive shaft adaptor for a 400 for a White Superior compressor and FIG. 4B shows a cross-sectional view of the drive shaft adapter of FIG. 4A.
Figure 4B:
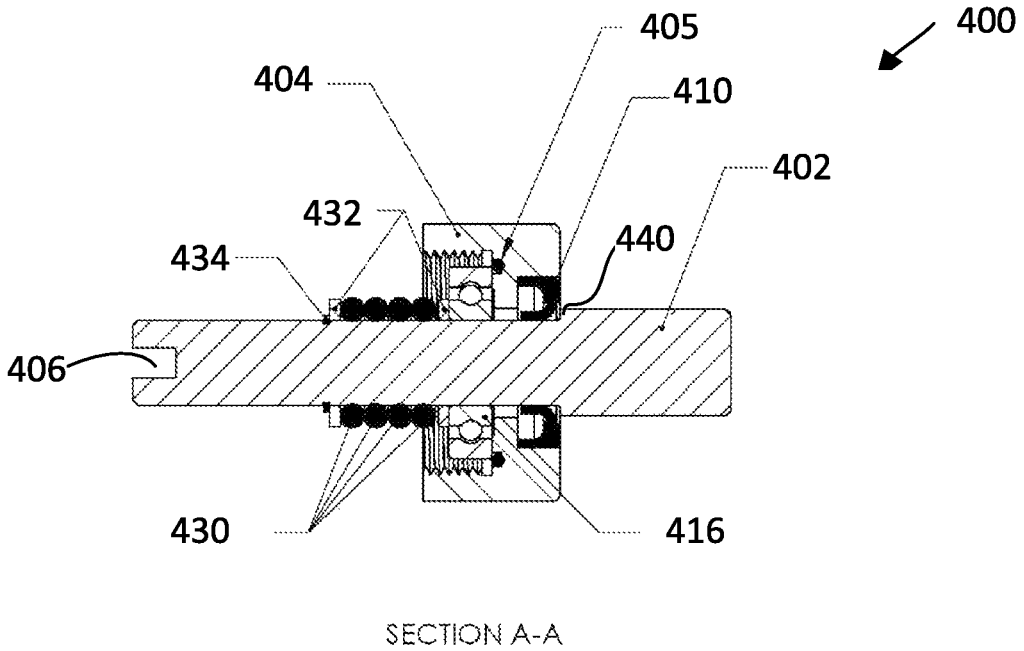

FIG. 4A shows a front view of a drive shaft adapter 400 for a White Superior compressor. Drive shaft adapter 400 comprises a proximal shaft segment 402 and a bearing housing 404. Proximal shaft segment 402 includes a slot 406 that matches with the key in the center drive shaft segment assembly 102*b* (FIG. 1B) and a key slot 408 by which a compressor (not shown) can drive proximal shaft segment 402. FIG. 4B shows a cross section of drive shaft adapter 400 taken along line A-A of FIG. 4A.

The bearing housing 404 screws onto a threaded portion of front bearing housing 163 (FIG. 1) and an O-ring 405 seals the connection between bearing housing 204 and front bearing housing 163. A shaft seal 410 seals the proximal shaft segment. A bearing 416 supports rotation of the shaft segment 402. Multiple O-ring shock absorbers 430 are positioned between spacers 432 and held in place by retaining ring 434. Shaft 402 changes diameter at a shoulder 440 that limits movement in one direction of shaft bearing mount 404, while movement in the opposite direction is restricted by O-ring shock absorbers 430 and retaining ring 434.

These drive shaft examples seal-bearing assembly end portions are shown as examples and not as limitations. The wide variety of drive shaft adapters and seal-bearing assembly end portions allow the lube box to be adapted to essentially any type of compressor, thereby greatly reducing the inventory of lube boxes required to be maintained by maintenance shops and reducing downtime caused by delays in replacing defective lube boxes. Adapters for other compressors can easily be designed using the examples provided herein. While three-part shaft 100 is described in detail, the invention is not limited to a three-part shaft or to any particular design of the shaft, seals, and bearings. For example, some compressors limit longitudinal motion of the shaft, and such compressor may not require shock mount O-rings.

Lube Box

Figure 5:
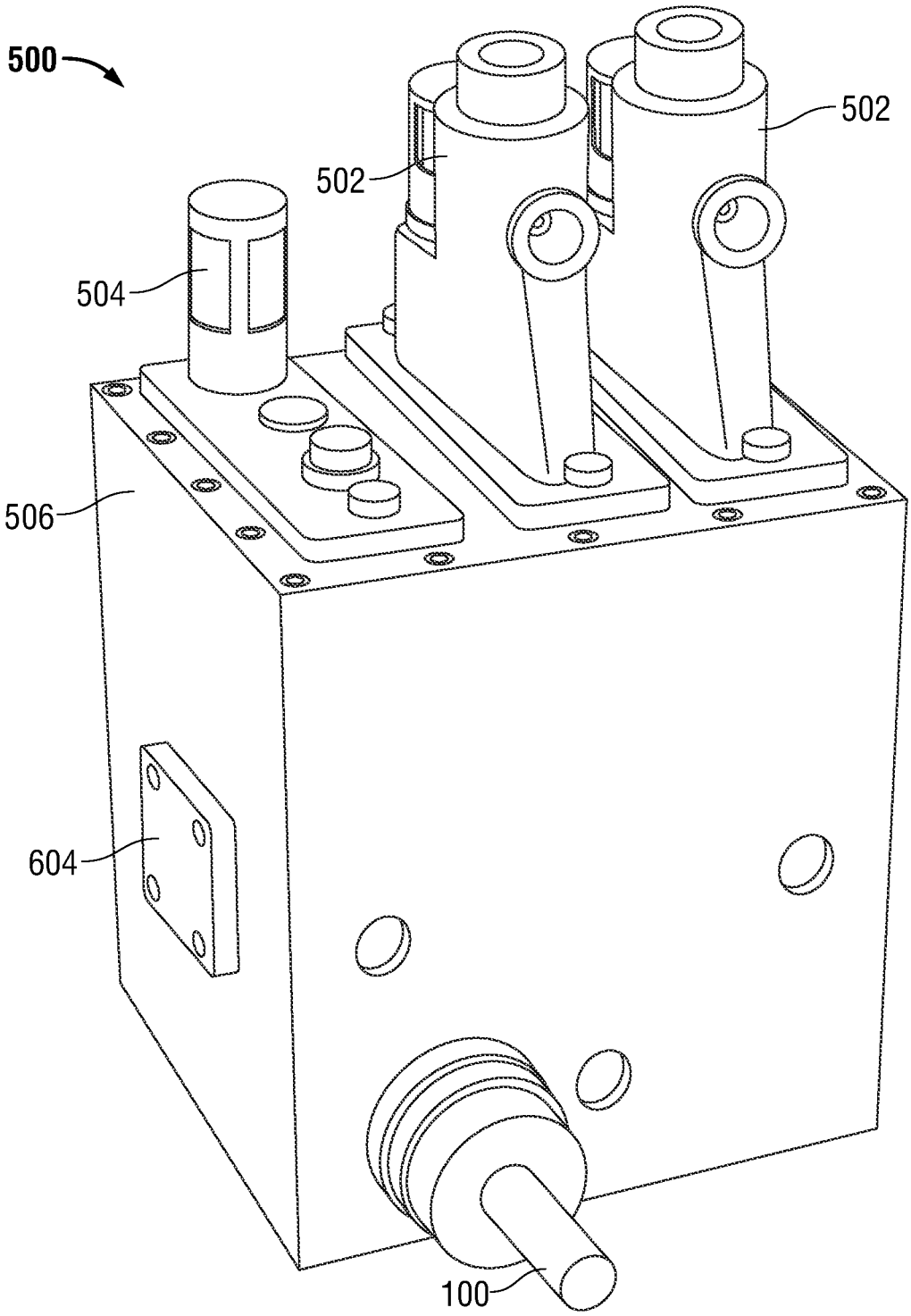
FIG. 5 shows a lube box with 2 pumps mounted.

The three-part shaft 100 extends through a lube box 500 as shown in FIG. 5. Pumps 502 are mounted on lube box 500. An external oil level indicator 504 shows the oil level within the lube box.

Figure 6:
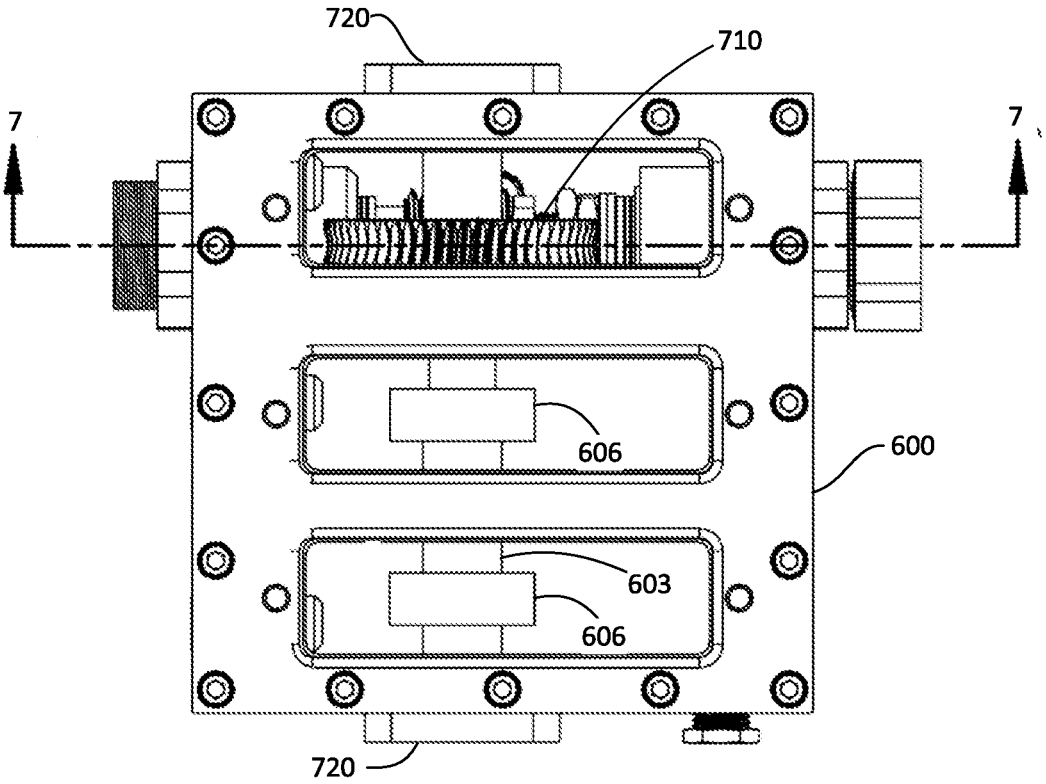
FIG. 6 is a top view of a lube box with the pumps removed.
Figure 7:
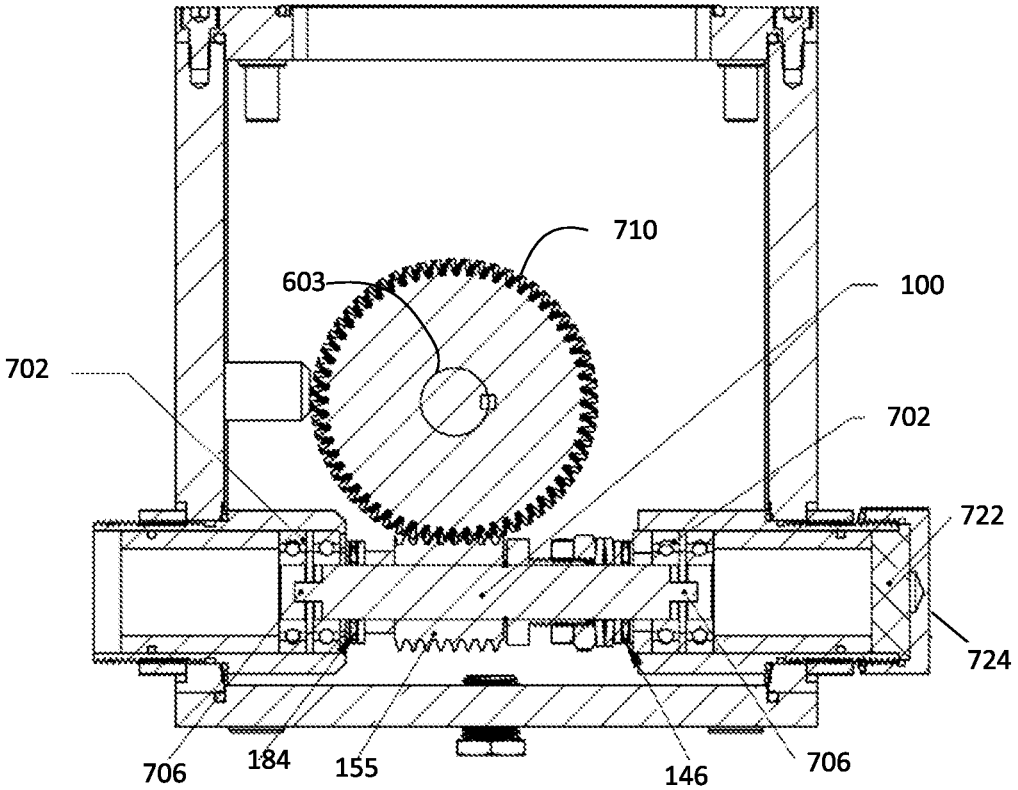
FIG. 7 is a cross-sectional view of the lube box of FIG. 6.

FIG. 6 a top view of a lube box 600 with the pumps removed. A cross section of lube box 600 taken along the line 7-7 is shown in FIG. 7. FIG. 7 shows a worm wheel 710 on the cam shaft 603 is driven by a worm 155 (FIG. 1A) on the drive shaft 100, which is driven by the compressor (not shown). Two pumps 502 (FIG. 5) mounted on lube box enclosure 500 are operated by cams 606 on cam shaft 603. Two sets of twin bearing 702 support drive shaft 100 at drive couplers 706. Thrust bearings 708 absorb force in either direction along the shaft axis. Caps 710 at each end of cam shaft 603 seals the interior of lube box 600 around cam shaft 603. The cam shaft can be readily removed while the lube box remains attached to the compressor yet provides a waterproof enclosure that prevents water and contaminants from entering the lube box. An end plug 722 keeps drive shaft 100 longitudinally positioned, is kept in place by a sealing nut 724.

Modular, Expandable Design

A preferred embodiment is modular in design. An extra lubricant compartment can be mounted to the existing lubricator reservoir along with a longer camshaft with additional cams to operate additional pumps mounted onto the extra lubricant compartment. The addition of extra lubricator pumps allows the lubricant output to be increased, eliminating the need to purchase a completely new lubricator reservoir if a larger volume of lubricant is needed to lubricate the compressor components.

Figure 8:
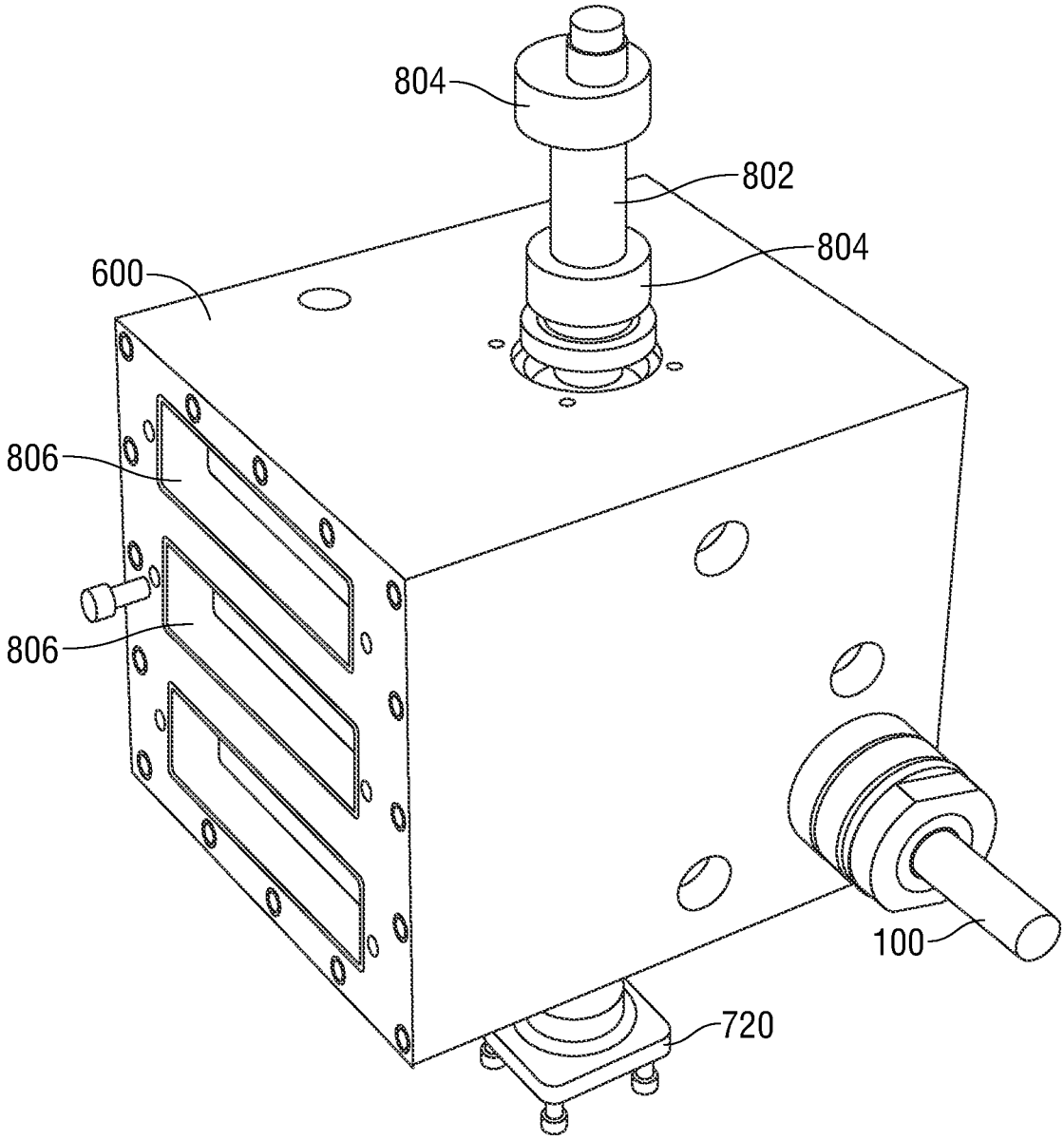
FIG. 8 shows a lube box with an extended cam shaft.
Figure 9:
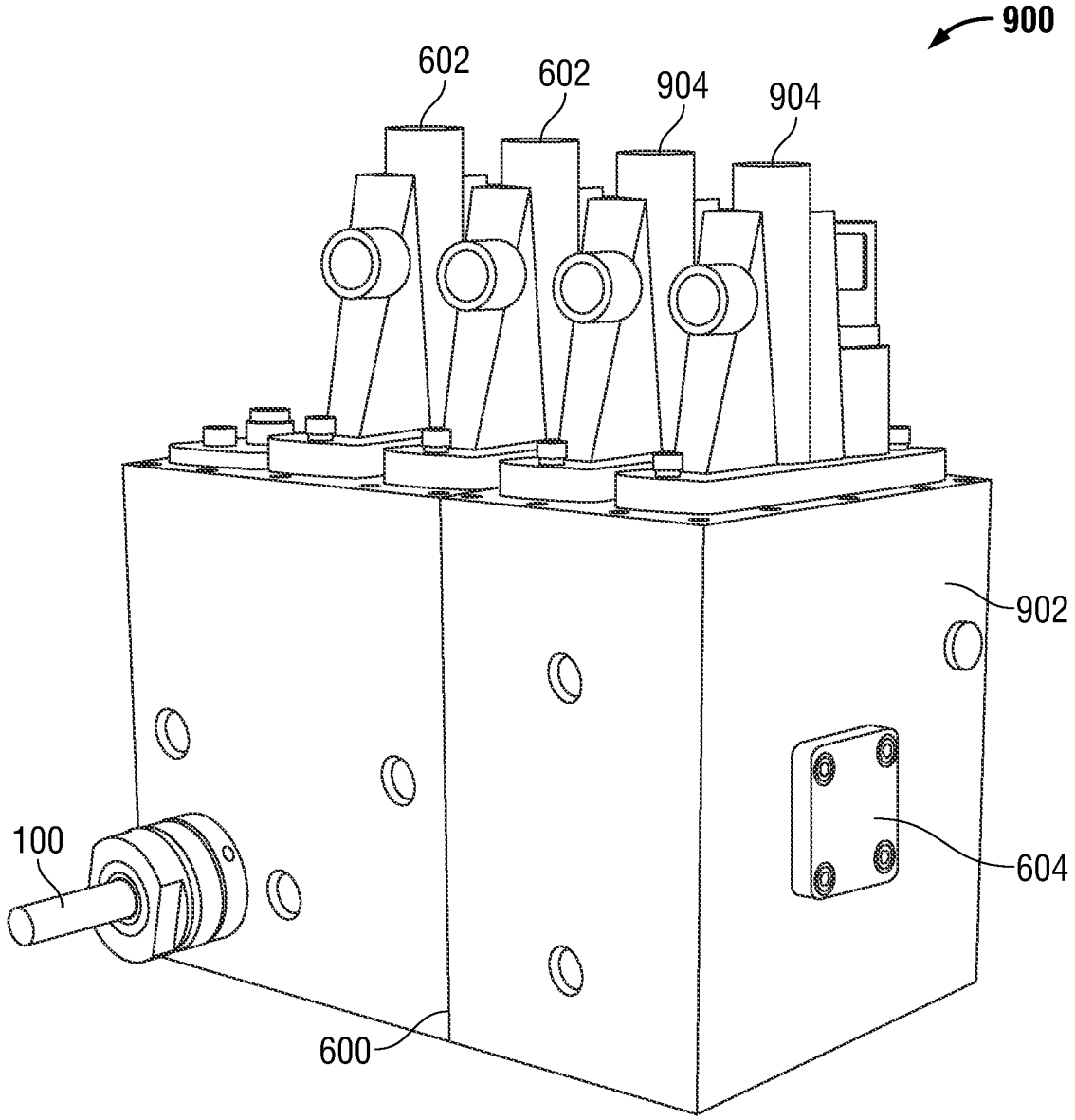
FIG. 9 shows a lube box with two pumps and an extension chamber supporting an additional two pumps.

As shown in FIG. 8, the cam shaft 603 of FIGS. 6 and 7 has been replaced with a longer cam shaft 802 that extends outside of the lube box 600. FIG. 8 shows the lube box enclosure 600 with the extended cam shaft 802 and a cap 720 on the extended cam shaft to seal the extended cam shaft at the lube box wall. FIG. 8 shows additional cams 804 positioned on the extended cam shaft 702. Slots 806 are for two mounting pumps (not shown) on lube box 600. FIG. 9 shows a lube box assembly 900 with lube box extension enclosure 902, with 2 pumps 602 mounted on the lube box enclosure 600 and 2 additional pumps 904 mounted on the lube box extension 902 and driven by the cams 804 on the extension cam shaft 802. Drive shaft 100 that mates with the compressor is also visible.

Quick Change Mounting Adapters

A preferred lube box system incorporates quick change mounting components that can be easily used with a lube box to allow the operator, mechanic, or product distributor to easily mount any adapter plate in a matter of minutes, that will mate to any reciprocating compressor frame.

The mounting adapter plates include mounting holes that match the mounting holes of a specific compressor and position the lube box so that the drive shaft is positioned properly for mating with the compressor. The thickness of the adapter is chosen to provide the correct penetration of the drive shaft from the lube box into the compressor. The quick change mounting adapter plate may include holes or bosses for mounting the lube box to the mounting adapter, and then different holes or bosses to mount the adapter to the compressor in a position such that the shaft 100 of the lube box assembly is properly positioned to mate with the compressor.

Figure 10:
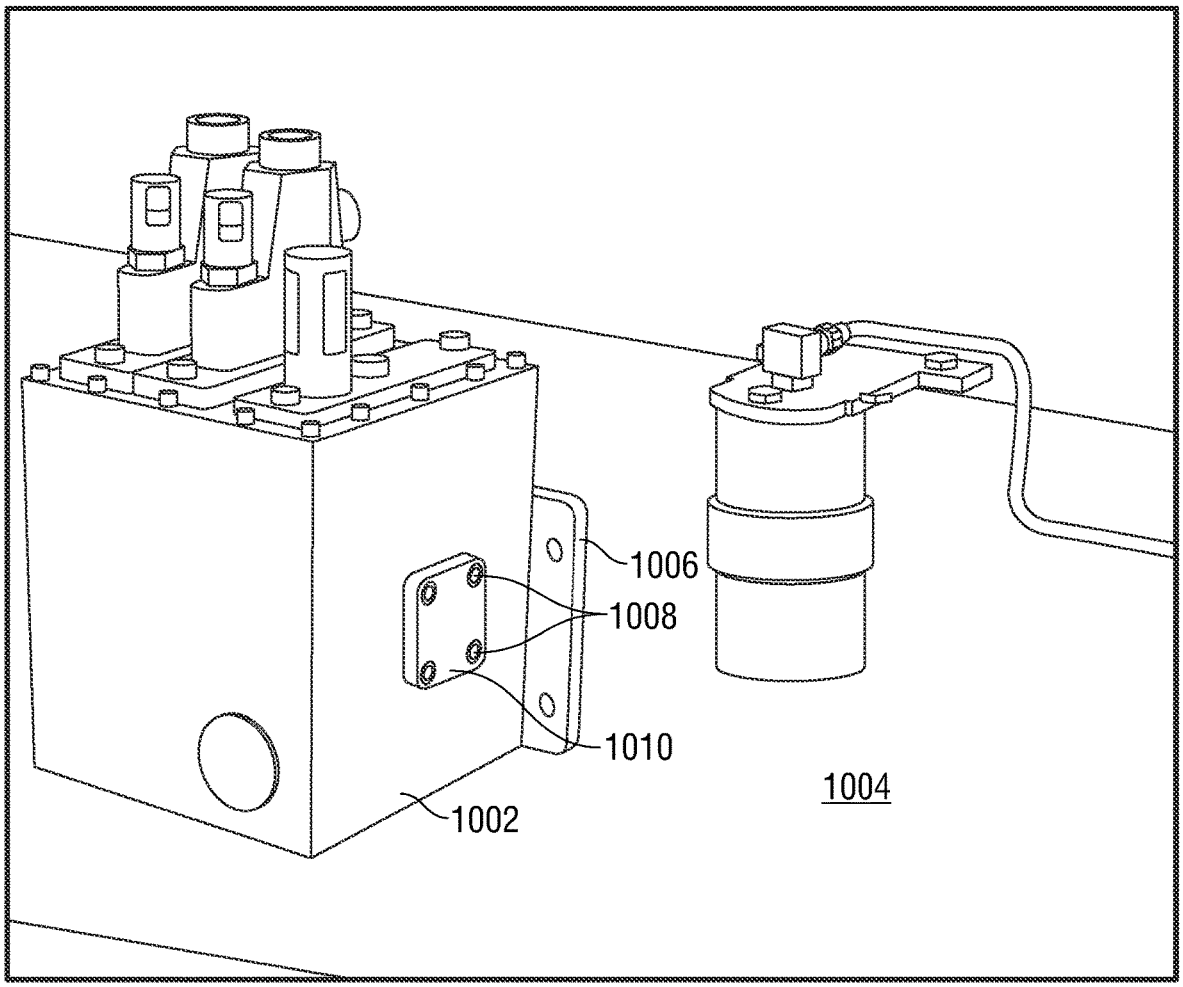
FIG. 10 shows a lube box attached to a compressor.

FIG. 10 shows an example of a lube box 1002 mounted to a compressor 1004 using a quick change mounting plate 1006. FIG. 10 also shows four fasteners 1008 used to attach an end cap 1010 along the cam shaft axis. A combination of mounting adaptor plates and the multipart drive shaft that includes a proximal portion, that is, a shaft adapter, that can be adapted to mate with a specified compressor allows embodiments of the lube box to be used with any compressor. The term "mounting adaptor plates" can refer not just to the plate itself, but to any spacers or other hardware used with the plate.

FIGS. 11-21 show examples of lube boxes 600 with quick change mounting adapter components to adapt lube box 600 to different compressors. FIGS. 11-21 show that the adapter plates can be mounted on different sides of the lube box and the drive shaft 100 can extend from different sides of the lube box. To adapt lube boxes 600 to some compressors, spacers are required to position the adapter plate away from the compressor. For some compressors, no spacers are required.

Figure 11:
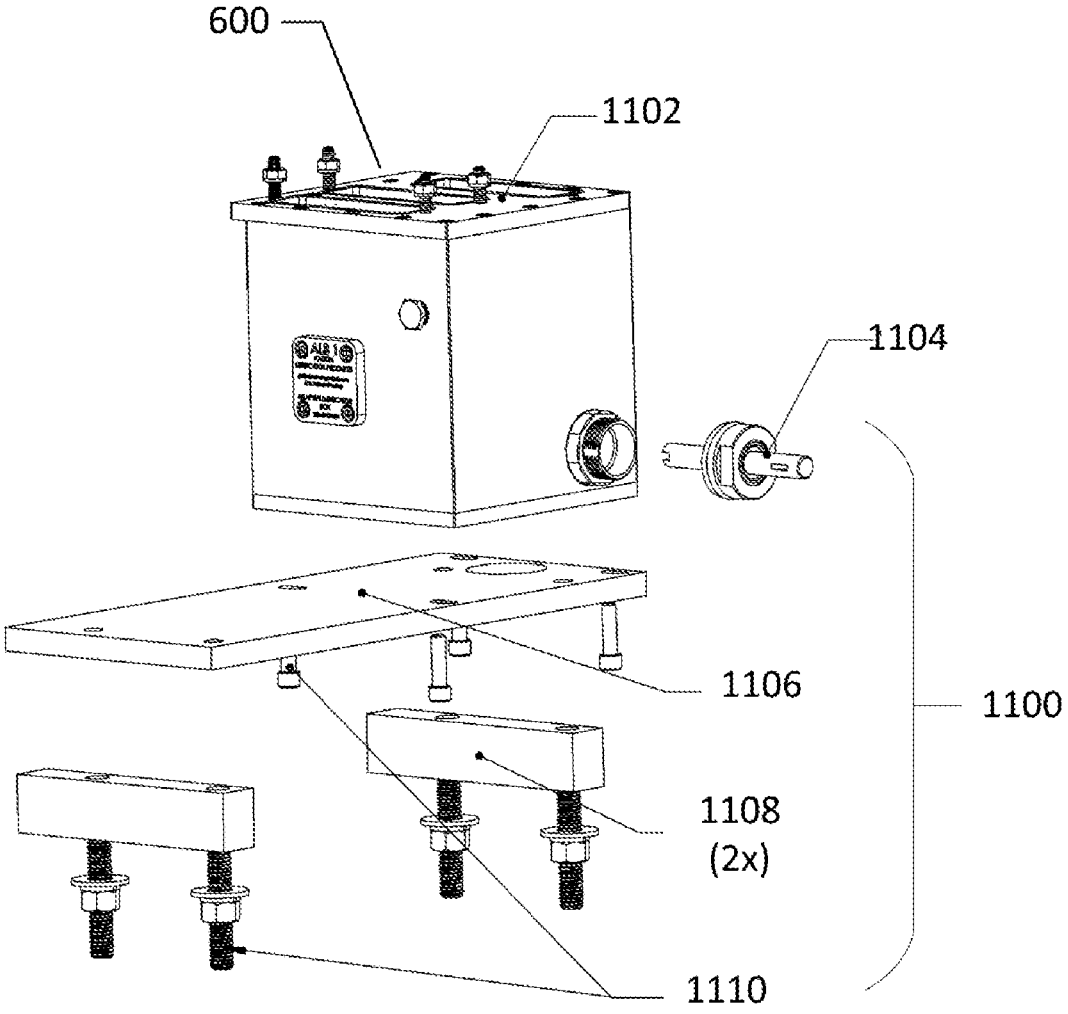
FIG. 11 shows quick change mounting adapter components used to adapt a lube box to a White Superior compressor.

FIG. 11 shows quick change mounting adapter components 1100 used to adapt the lube box 600 to a White Superior compressor (not shown). The mounting adapter components includes an adapter plate 1106 and two spacers 1108. Mounting hardware 1110 is used to secure the adapter plate to the White Superior Compressor via the spacers 1108 and to secure the lube box 500 to the adapter plate 1106. A rear drive adapter plate 1102 is attached to the top of the lube box 500 for attaching the pumps (not shown). A shaft adapter 1104 is adapted at a first end to be powered by the White Superior compressor and at a second end to mate with a center shaft segment assembly 102*b* (FIG. 1A).

Figure 12:
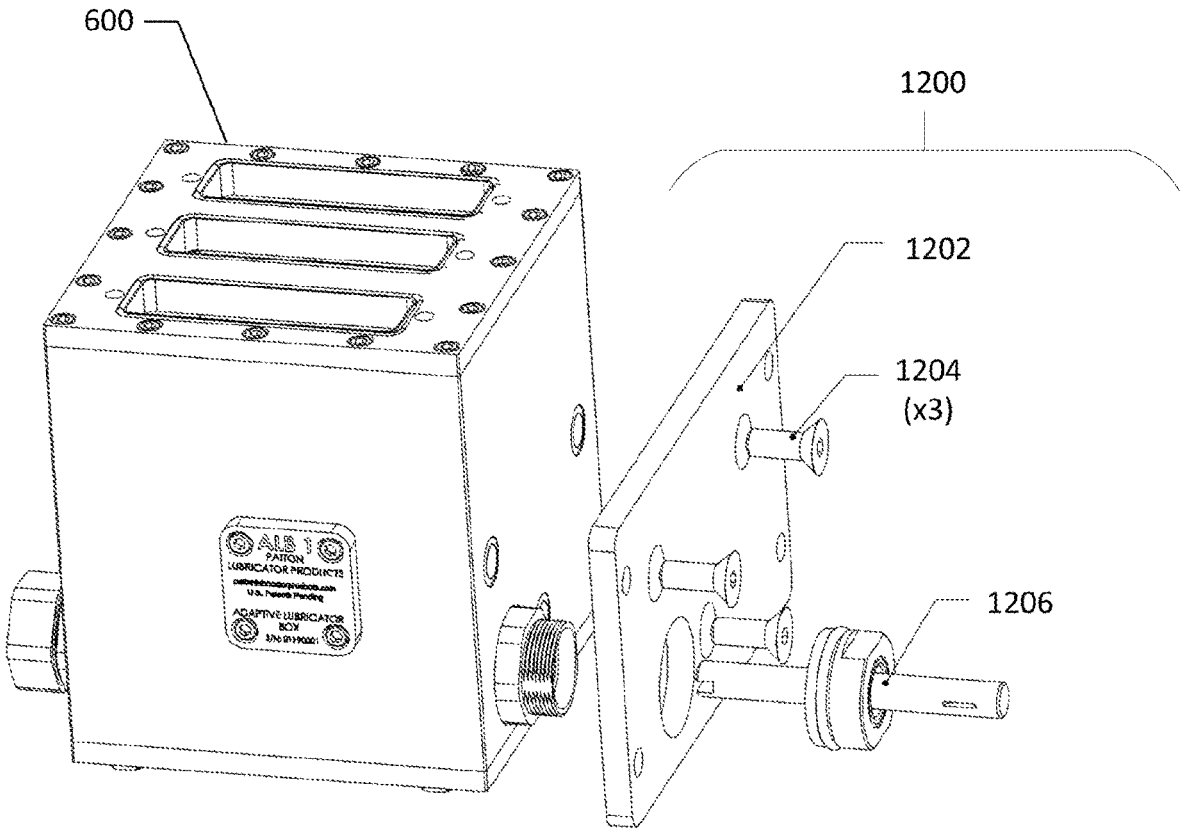
FIG. 12 shows quick change mounting adapter components used to adapt a lube box to an Ariel 2 compressor.

FIG. 12 shows quick change mounting adapter components 1200 used to adapt the lube box 600 to an Ariel 2 compressor (not shown). The components include a mounting plate 1202 and mounting screws 1204 that mount the adapter plate 1202 to the Arial 2 compressor. A shaft adapter 1206 is adapted at a first end to be powered by the Ariel 2 compressor and at a second end to mate with a center shaft segment assembly 102*b* (FIG. 1A).

Figure 13:
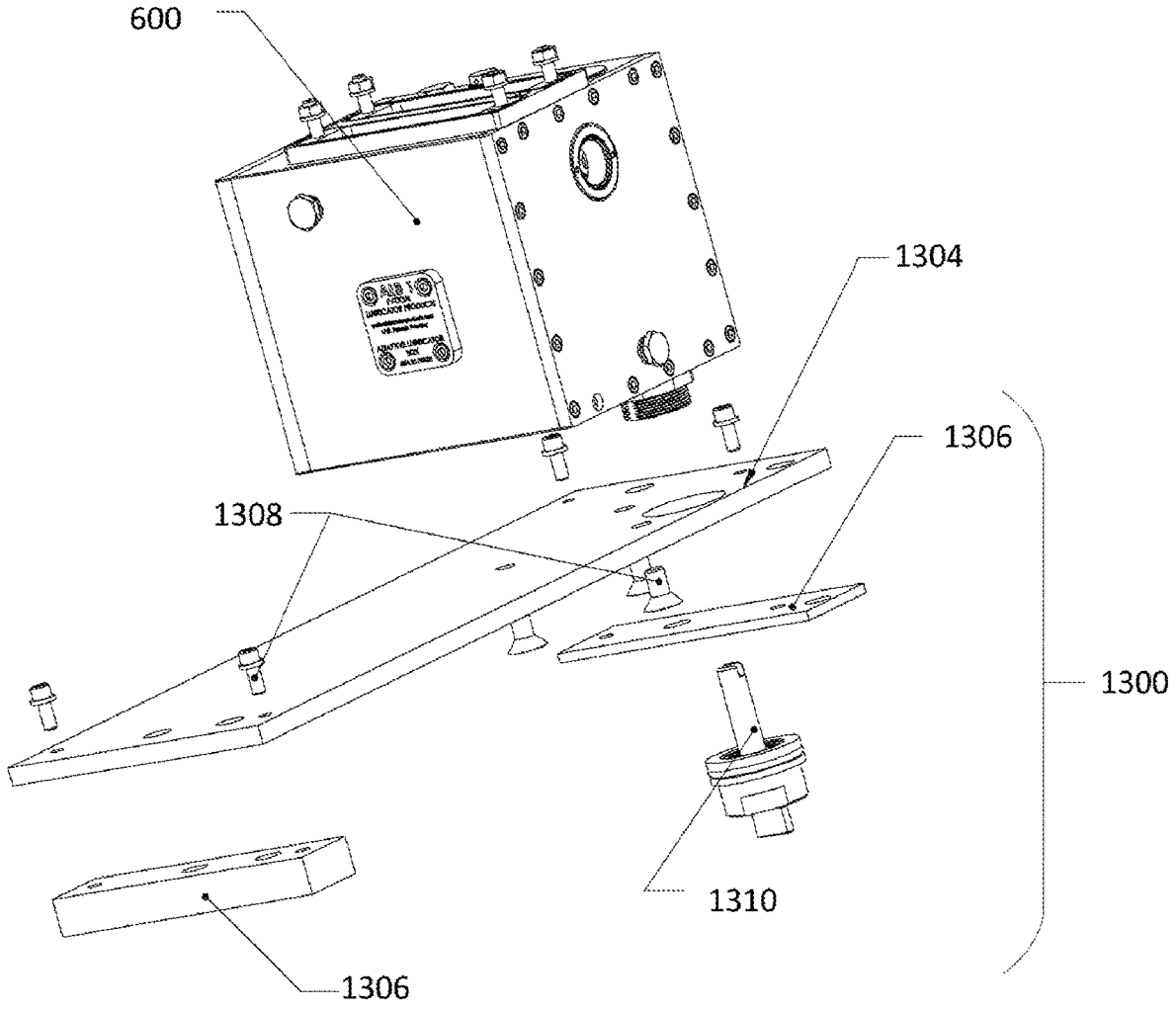
FIG. 13 shows quick change mounting adapter components used to adapt a lube box to an Ajax compressor.

FIG. 13 shows quick change mounting adapter components 1300 used to adapt the lube box 600 to an Ajax compressor, (not shown) in which the shaft for driving the lube box pump extends vertically from the Ajax compressor. The mounting adapter components includes an adapter plate 1304 and two spacers 1306. Mounting hardware 1308 is used to secure the adapter plate to the Ajax Compressor via the spacers 1108 and to secure the lube box 600 to the adapter plate 1304. A shaft adapter 1310 is adapted at a first end to be powered by the Ajax compressor and at a second end to mate with a center shaft segment assembly 102*b* (FIG. 1A).

Figure 14:
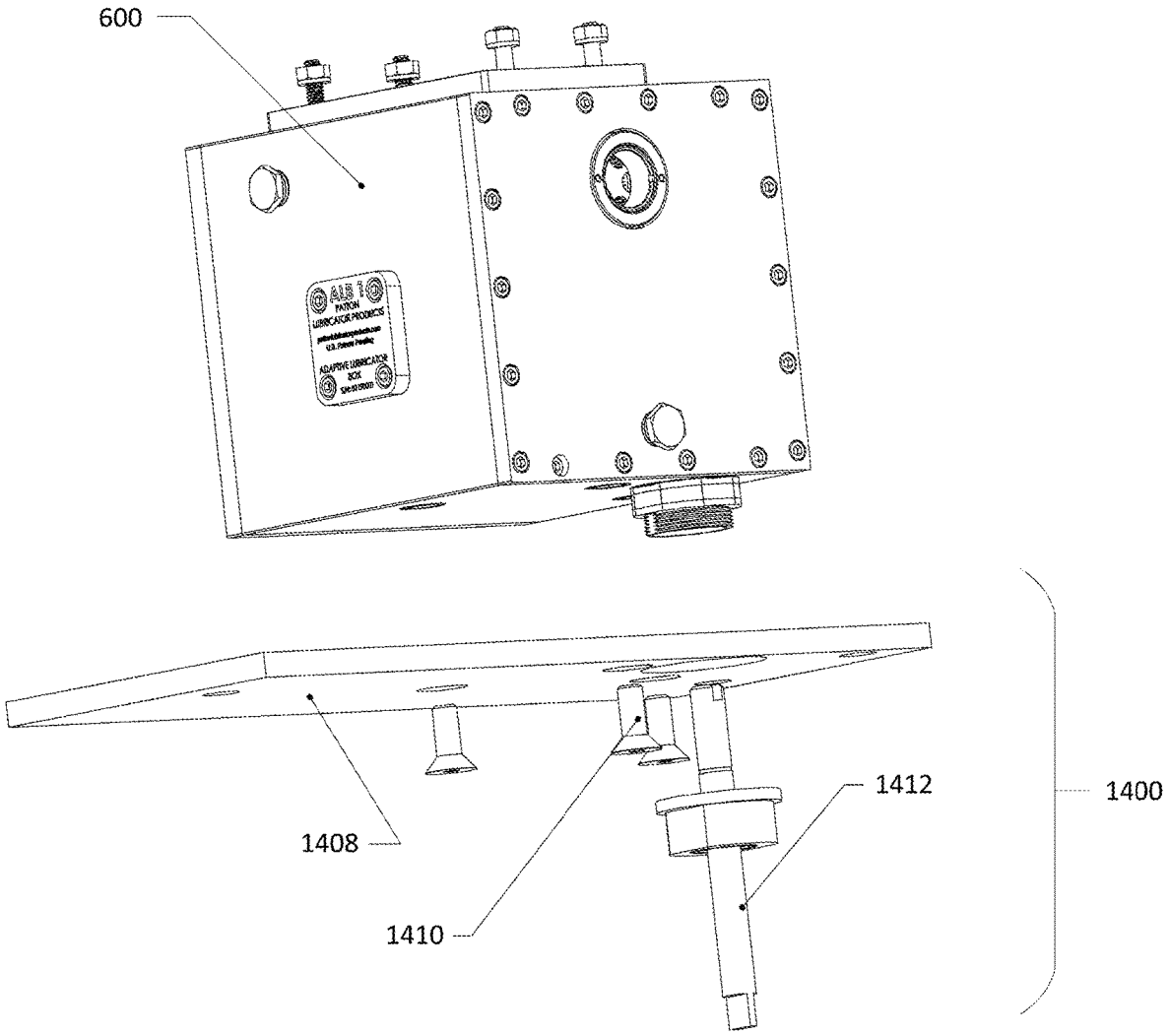
FIG. 14 shows quick change mounting adapter components used to adapt a lube box to a Joy WB compressor.

FIG. 14 shows quick change mounting adapter components 1400 used to adapt the lube box 600 to a Joy WB Compressor (not shown) in which the shaft for driving the lube box pump extends vertically from the Joy WB 14 compressor. The mounting adapter components includes an adapter plate 1408. Mounting hardware 1410 is used to secure the adapter plate 1408 to the Ajax Compressor. A shaft adapter 1412 is adapted at a first end to be powered by the Joy WB 14 compressor and at a second end to mate with a center shaft segment assembly 102*b* (FIG. 1A).

Figure 15:
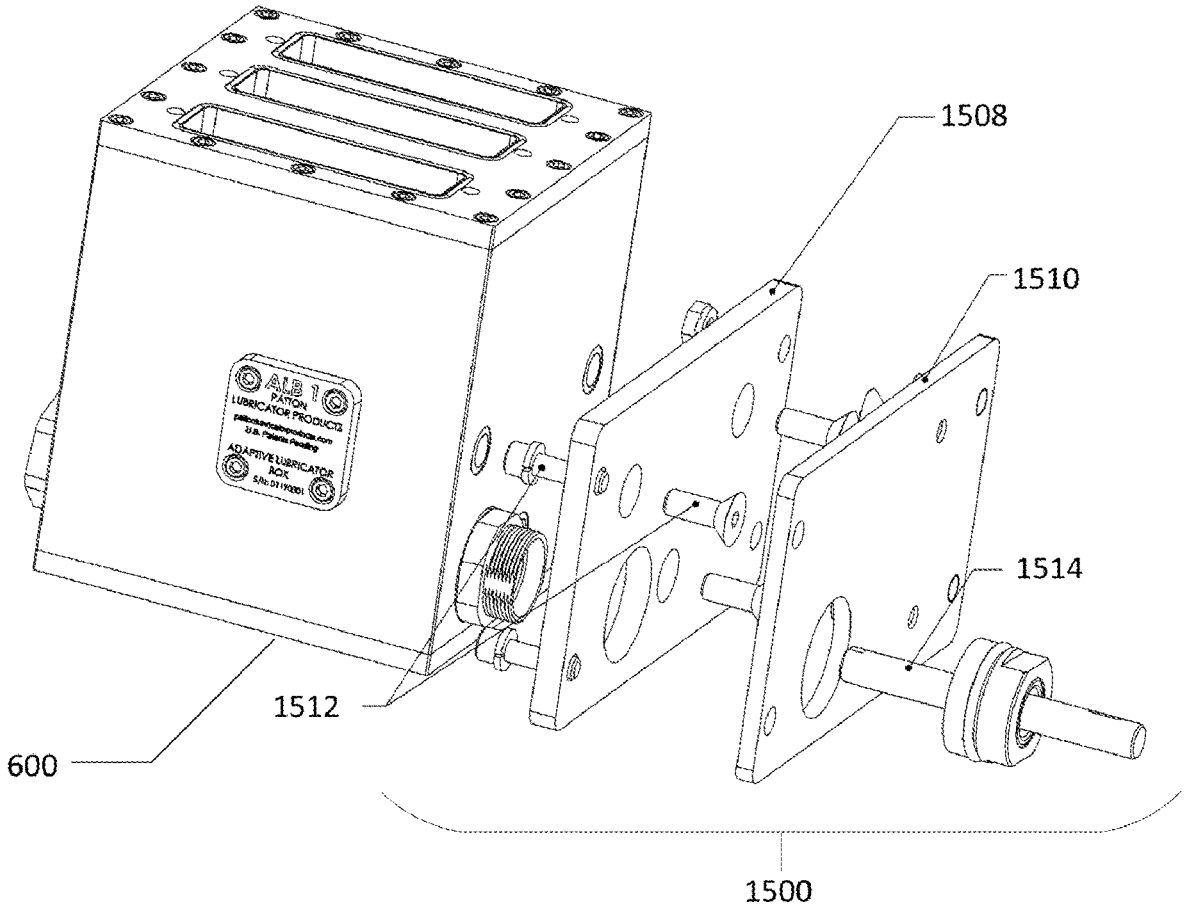
FIG. 15 shows quick change mounting adapter components used to adapt a lube box to an Ariel 1 compressor.

FIG. 15 shows quick change mounting adapter components 1500 used to adapt the lube box 600 to an Ariel 1 Compressor. As shown in FIG. 15, some compressors use a combination of multiple adapter plates. Use of more than one adapter plate allows the re-use of a first adapter design from a similar compressor model. The second adapter plate can then have a relatively simple design, thereby avoiding requiring a new complex adapter plate design. The mounting adapter components for the Ariel 1 compressor includes a first adapter plate 1508 that is designed for use with an Ariel 2 compressor and a second adapter plate 1510, that is designed to interface is positioned over the Ariel 2 adapter plate 1508. Mounting hardware 1512 is used to secure the first adapter plate 1508 to the Ariel compressor and to attach the second adapter plate 1510 to the first adapter plate 1508 and to the Ariel compressor. A shaft adapter 1514 is adapted at a first end to be powered by the Joy WB 14 compressor and at a second end to mate with a center shaft segment assembly 102*b* (FIG. 1A).

Figure 16:
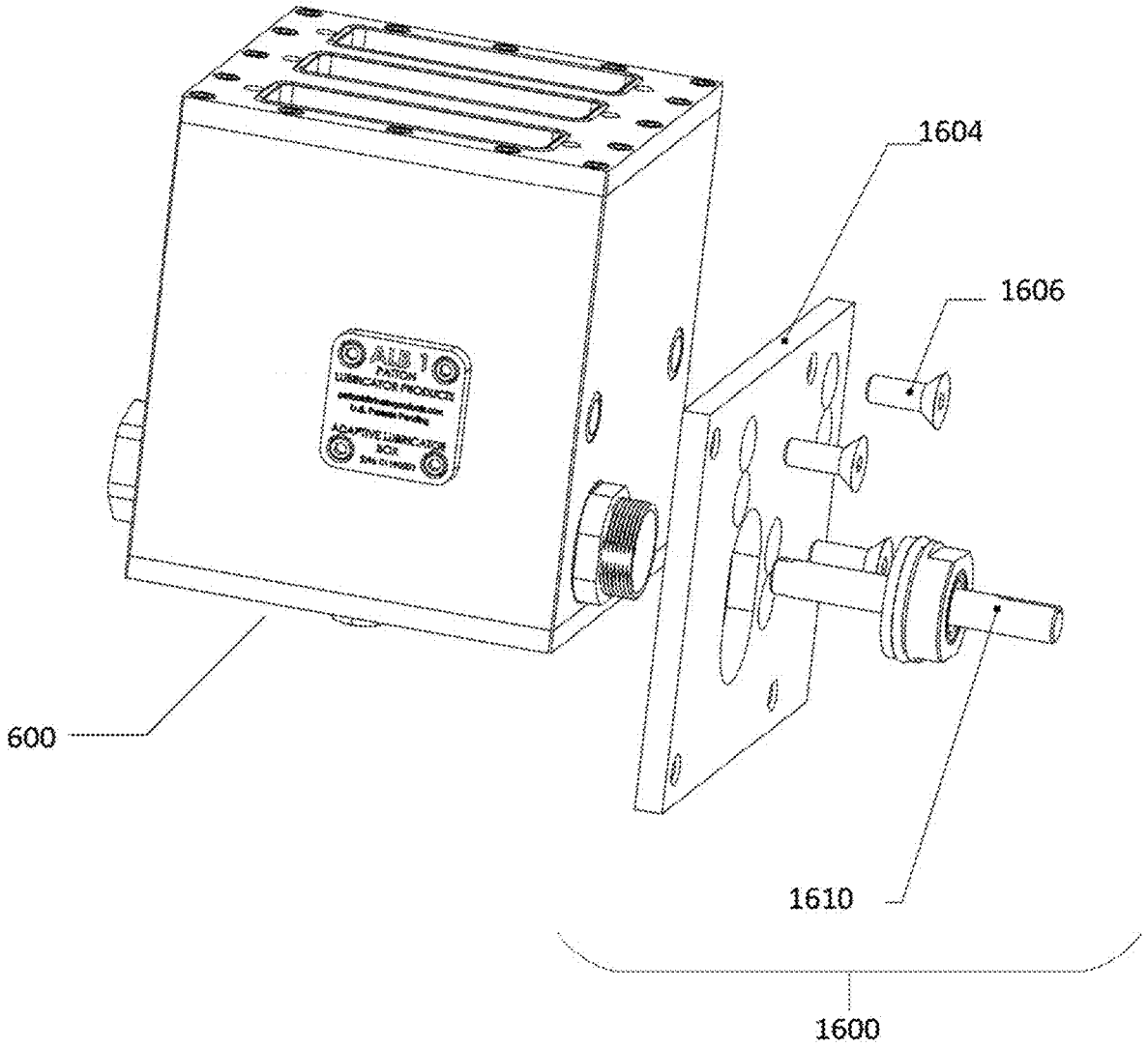
FIG. 16 shows quick change mounting adapter components used to adapt a lube box to a Chicago Pneumatic compressor.

FIG. 16 shows quick change mounting adapter components 1600 used to adapt the lube box 600 to a Chicago Pneumatic compressor (not shown). The mounting adapter components includes an adapter plate 1604. Mounting hardware 1606 is used to secure the adapter plate 1604 to the Chicago Pneumatic Compressor. A shaft adapter 1610 is adapted at a first end to be powered by the Chicago Pneumatic compressor and at a second end to mate with a center shaft segment assembly 102*b* (FIG. 1A).

Figure 17:
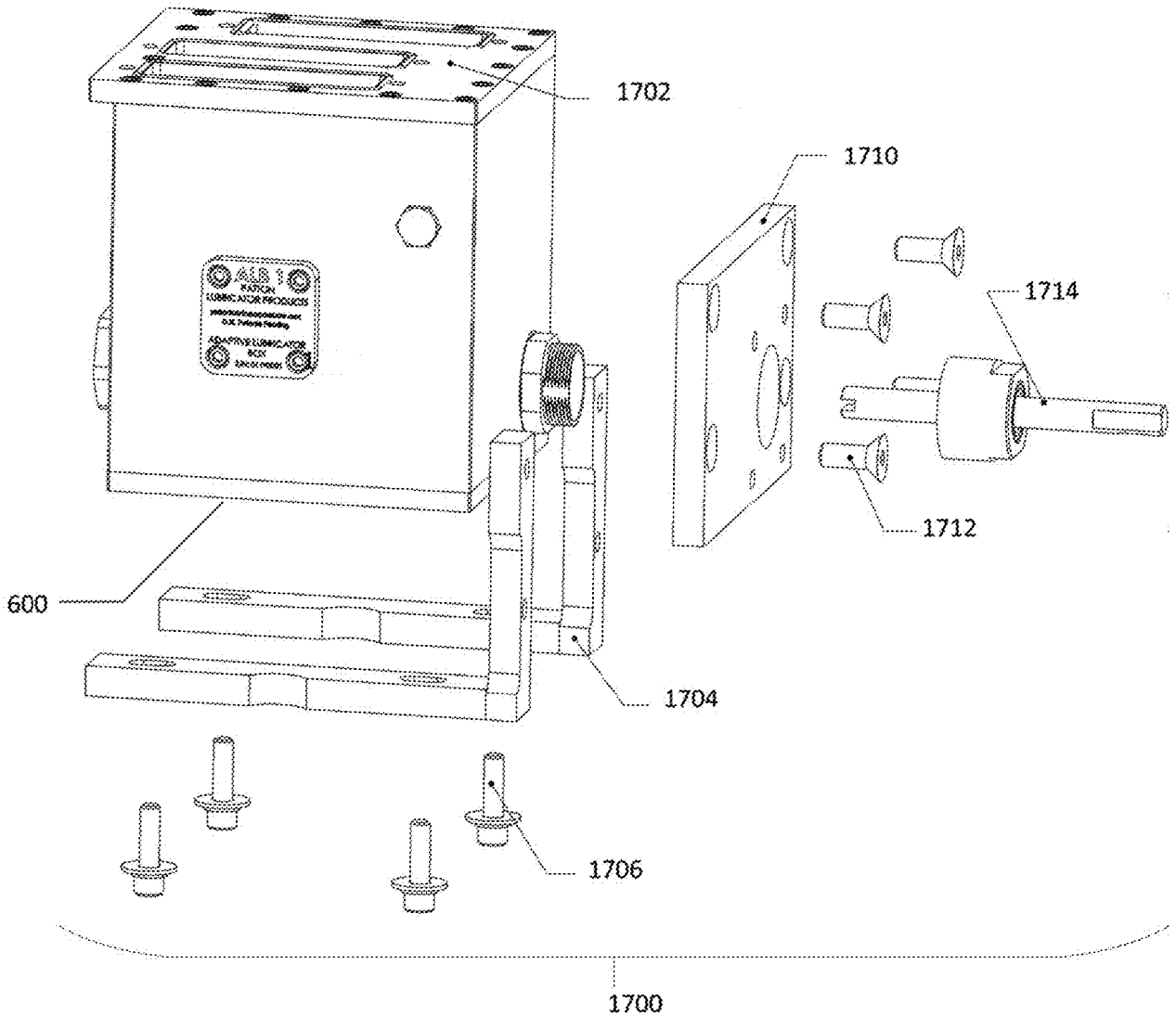
FIG. 17 shows quick change mounting adapter components used to adapt a lube box to a CIP compressor.

FIG. 17 shows quick change mounting adapter components 1700 used to adapt the lube box 600 to a CIP compressor (not shown). The mounting adapter components includes mounting brackets 1704 which is attached to lube box 600 using mounting bracket hardware 1706. A mounting plate 1710 is attached to the side of lube box 600 by mounting plate screws 1712. A shaft adapter 1714 is adapted at a first end to be powered by the CIP compressor and at a second end to mate with a center shaft segment assembly 102*b* (FIG. 1A).

Figure 18:
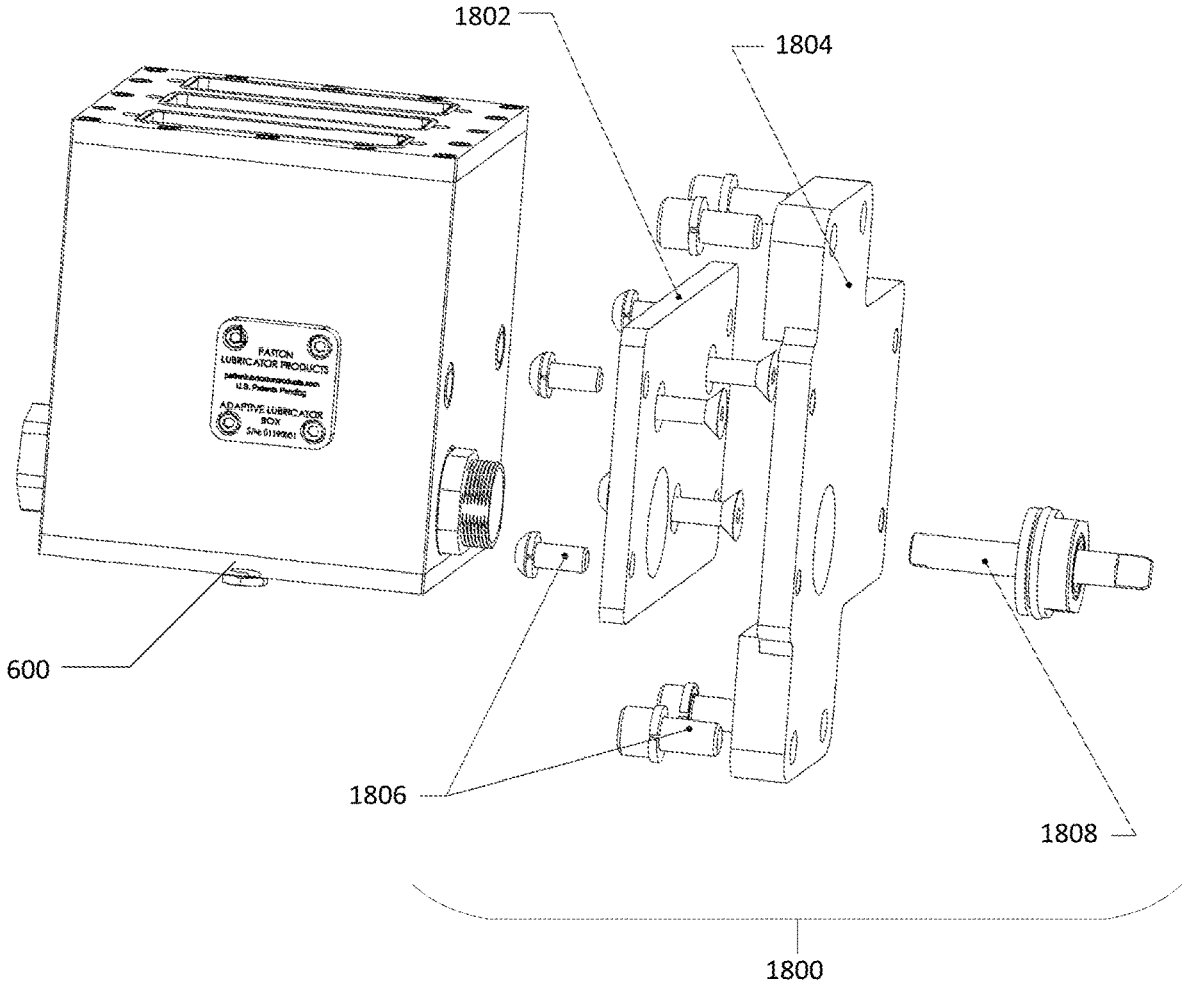
FIG. 18 shows quick change mounting adapter components used to adapt a lube box to a Dresser Rand compressor.

FIG. 18 shows quick change mounting adapter components 1800 used to adapt the lube box 600 to a Dresser Rand Compressor. Like the adaptor components in FIG. 15, the mounting adapter components for the Dresser Rand Compressor includes a first adapter plate 1802 that is designed for use with an Ariel 2 compressor and a second adapter plate 1804, that is designed to interface is positioned over the first adapter plate 1802. Mounting hardware 1806 is used to secure the first adapter plate 1802 to the Dresser Rand compressor and to attach the second adapter plate 1804 to the first adapter plate 1802 and to the Dresser Rand compressor. A shaft adapter 1808 is adapted at a first end to be powered by the Dresser Rand compressor and at a second end to mate with a center shaft segment assembly 102*b* (FIG. 1A).

Figure 19:
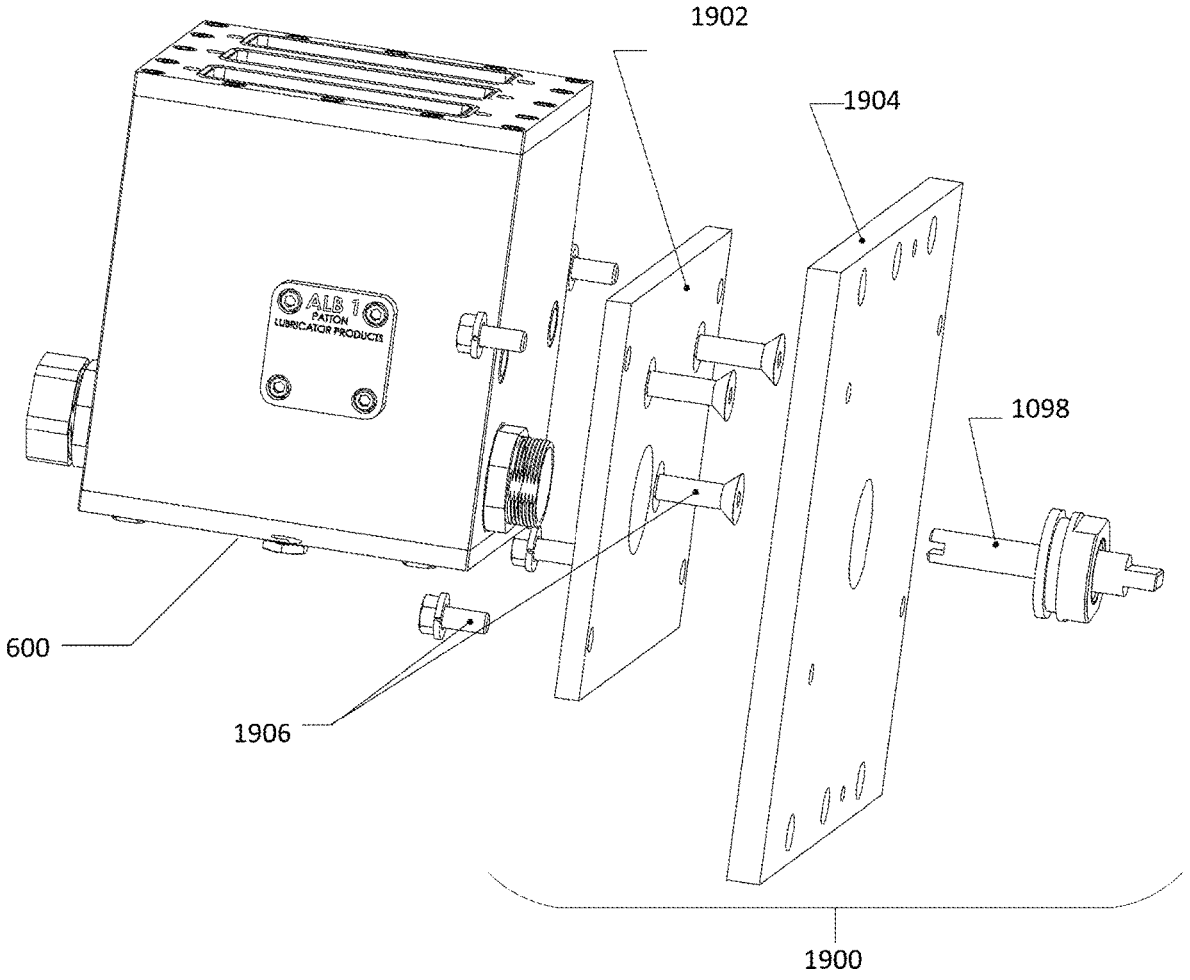
FIG. 19 shows quick change mounting adapter components used to adapt a lube box to a Joy WBFXHD compressor.

FIG. 19 shows quick change mounting adapter components 1900 used to adapt the lube box 600 to a Joy WBFXHD Compressor. Like the adaptor components in FIG. 15, the mounting adapter components for the Joy WBFXHD Compressor includes a first adapter plate 1902 and a second adapter plate 1904, that is designed to interface is positioned over the first adapter plate 1902. Mounting hardware 1906 is used to secure the first adapter plate 1902 to the Joy WBFXHD compressor and to attach the second adapter plate 1904 to the first adapter plate 1902 and to the Joy WBFXHD compressor. A shaft adapter 1908 is adapted at a first end to be powered by the Joy WBFXHD compressor and at a second end to mate with a center shaft segment assembly 102*b* (FIG. 1A).

Figure 20:
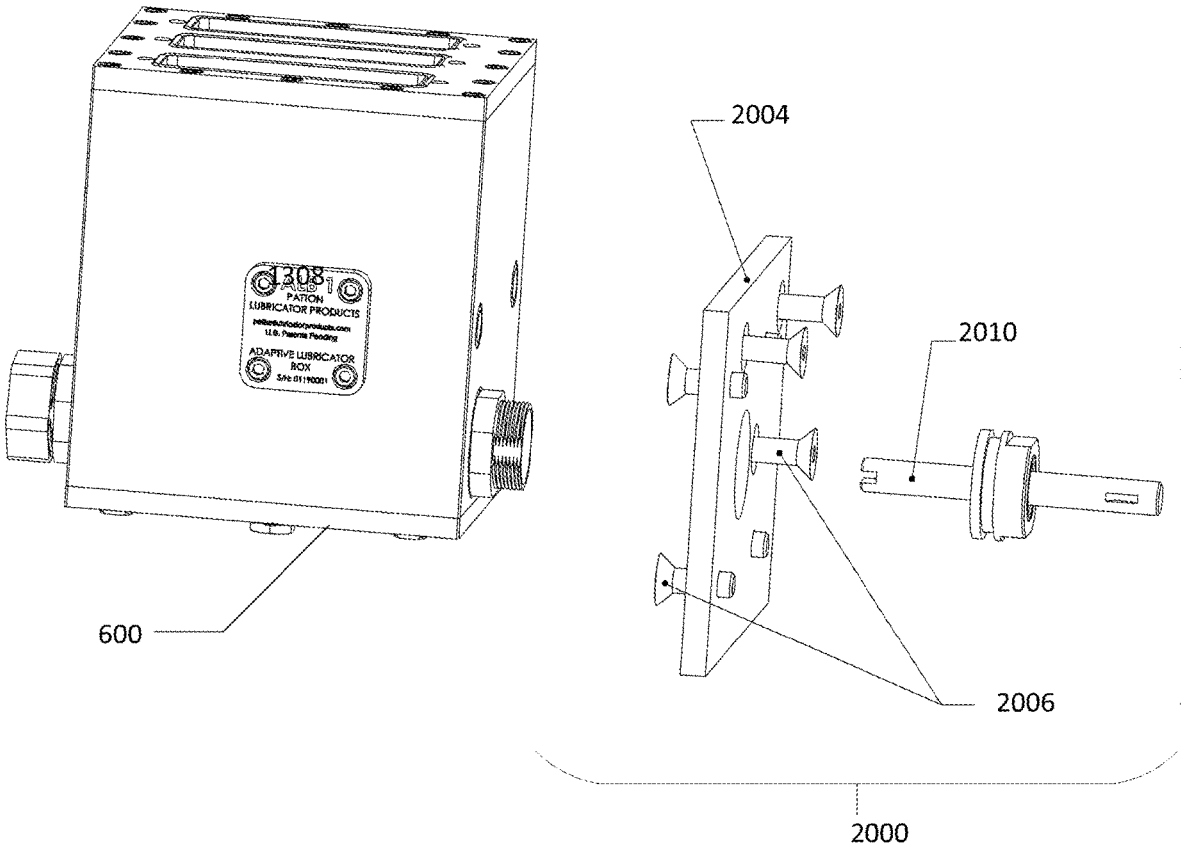
FIG. 20 shows quick change mounting adapter components used to adapt a lube box to a Knox Western compressor.

FIG. 20 shows quick change mounting adapter components 2000 used to adapt the lube box 600 to a Knox Western compressor (not shown). The mounting adapter components includes an adapter plate 2004. Mounting hardware 2006 is used to secure the adapter plate 2004 to the Knox Western Compressor. A shaft adapter 2010 is adapted at a first end to be powered by the Knox Western compressor and at a second end to mate with a center shaft segment assembly 102*b* (FIG. 1A).

Figure 21:
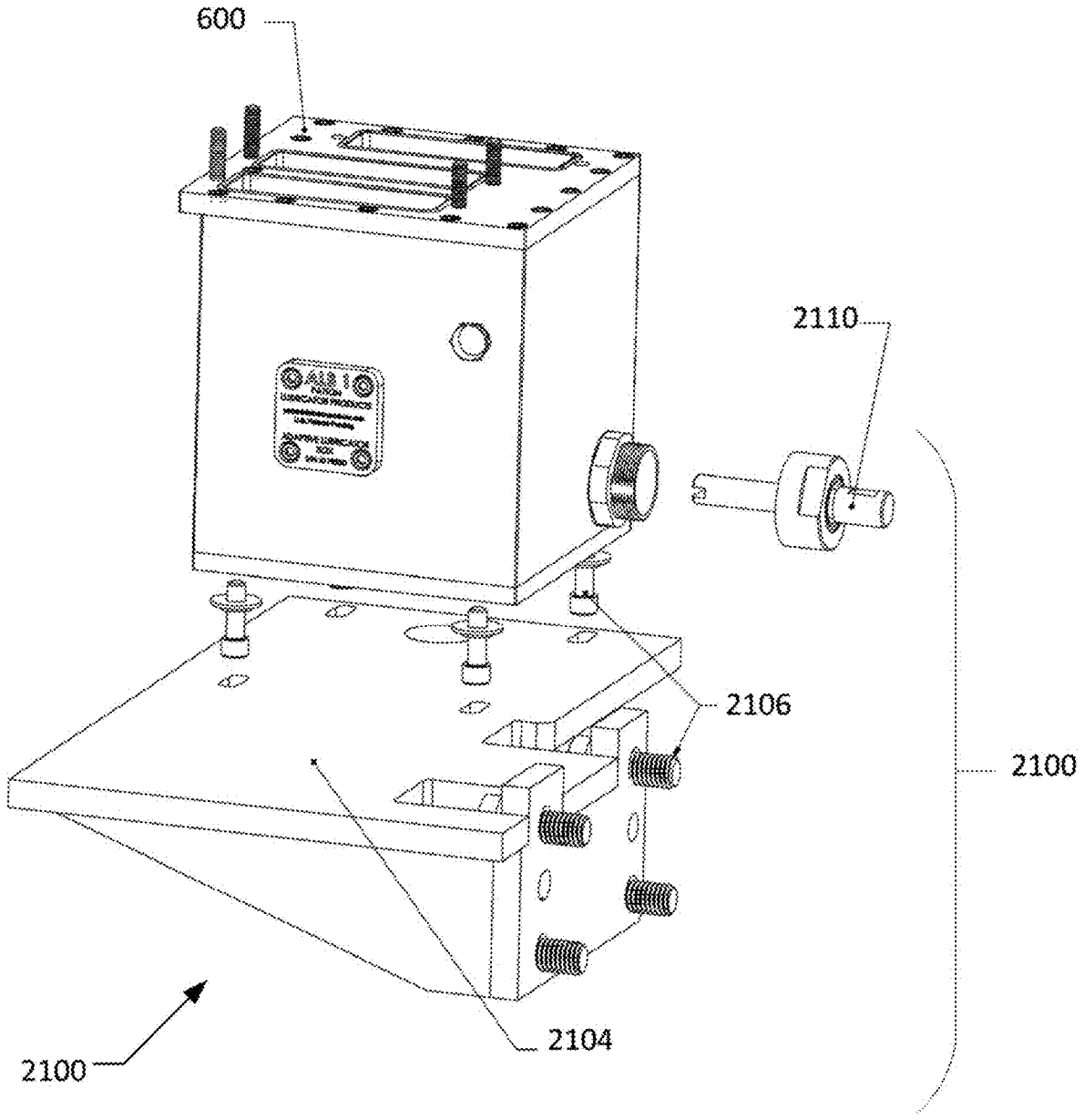
FIG. 21 shows quick change mounting adapter components used to adapt a lube box to a White Superior compressor.

FIG. 21 shows quick change mounting adapter components 2100 used to adapt the lube box 600 to a White Superior compressor (not shown). The mounting adapter components includes an adapter plate 2104. Mounting hardware 2106 is used to secure the adapter plate 2104 to the White Superior Compressor. A shaft adapter 2110 is adapted at a first end to be powered by the White Superior compressor and at a second end to mate with a center shaft segment assembly 102*b* (FIG. 1A). As shown in FIG. 21, the fasteners holding the adapter plate 2104 to the compressor are oriented ninety degrees to the fasteners holding the bottom of the lube box 600 to the adapter plate 2104. The adapter plate 2104 essentially provides a "shelf" for supporting the lube box 600 so that the shaft adapter 2110 is positioned and oriented to connect to the White Superior compressor.

Figure 22:
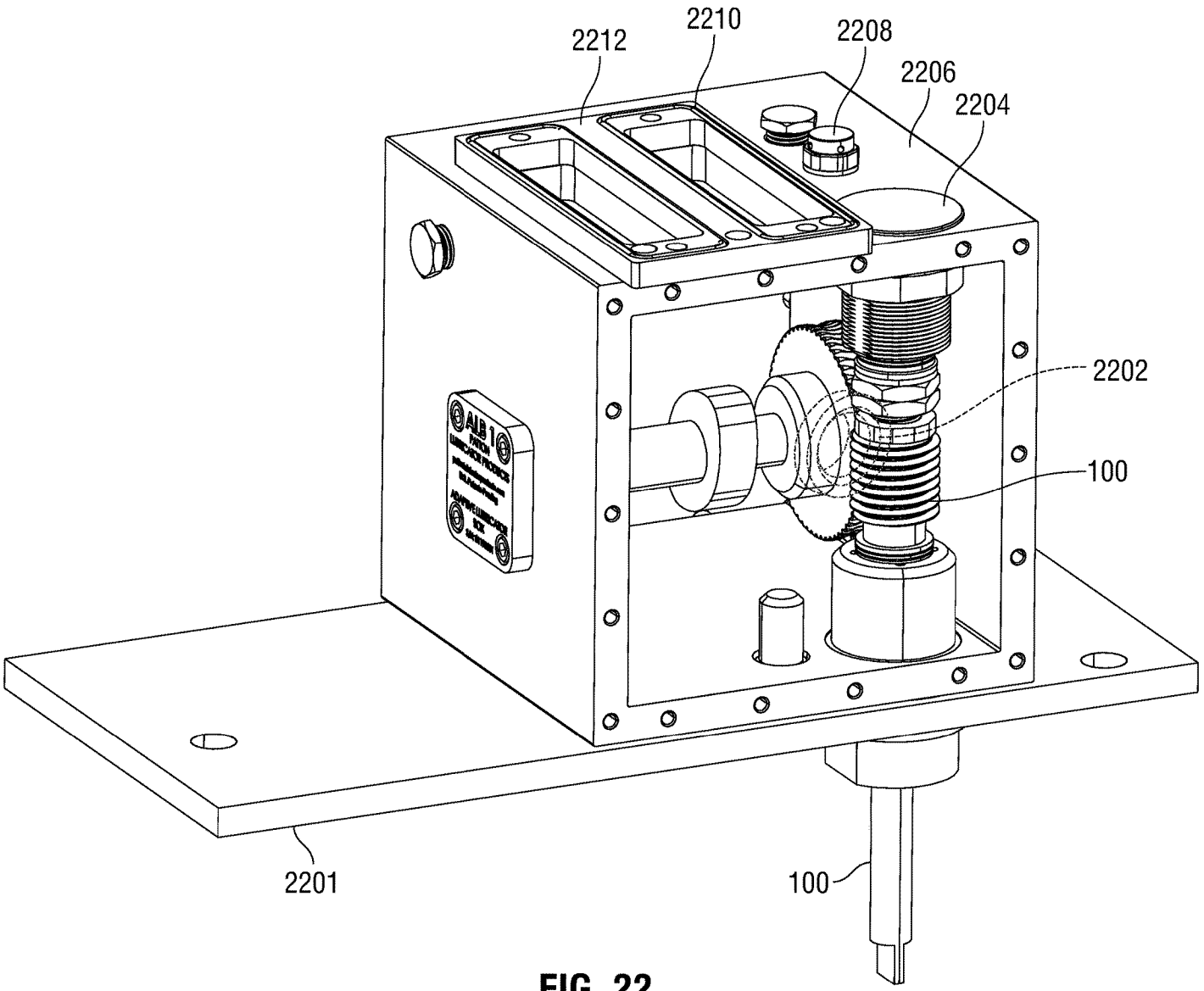
FIG. 22 shows a lube box mounted on mounting plate.

FIG. 22 shows a lube box 600 mounted on mounting plate 2201. The lube box includes a bullseye sight gauge 2202.

Visible in FIG. 22 is also a vertical drive rear bearing housing 2204, a standard box with modified side panel rotated for vertical drive 2206, a balancing vent plug 2208, plug mounting seals 2210, and a spacer pump mounting plate 2212.

The mounting adapter plates shown in FIGS. 11-21 are examples that show the flexibility of the mounting adapter concept and, based on these example, skilled persons will be able to create an adapter for any compressor. The wide variety of possible mounting plate adapters allows the lube box to be adapted to essentially any type of compressor, thereby greatly reducing the inventory of lube boxes required to be maintained by maintenance shops and reducing downtime caused by delays in replacing defective lube boxes. Mounting plates allow the lube box to be mounted to a compressor, regardless of the compressor shaft orientation. For example, mounting adapters are available for the Joy vertical drive compressor in which the drive shaft is parallel to the pump drive rods as shown in FIGS. 13 and 14 and horizonal drive compressors in which the drive shaft extends from either side of the lube box.

Reversable Lube Box with Top Plate

A typical lube box includes a cam shaft oriented at ninety degrees to the drive shaft coming from the compressor, as shown, for example, in FIG. 7. The cams convert the rotary motion of the cam shaft to up and down motion of rods that drive pumps. The rods may ride on the cams of the cam shaft or the rods may be driven by rocker arms. The pumps are attached to the top plate of the lube box, which has openings for attaching the pumps and allowing the rods to extend from the lube box to drive the pumps. Each pump draws lubricant from the lube box reservoir and outputs the lubricate through an outlet hole. The mounting holes in the top plate align the pumps with the rods in the lube box.

Figure 23A:
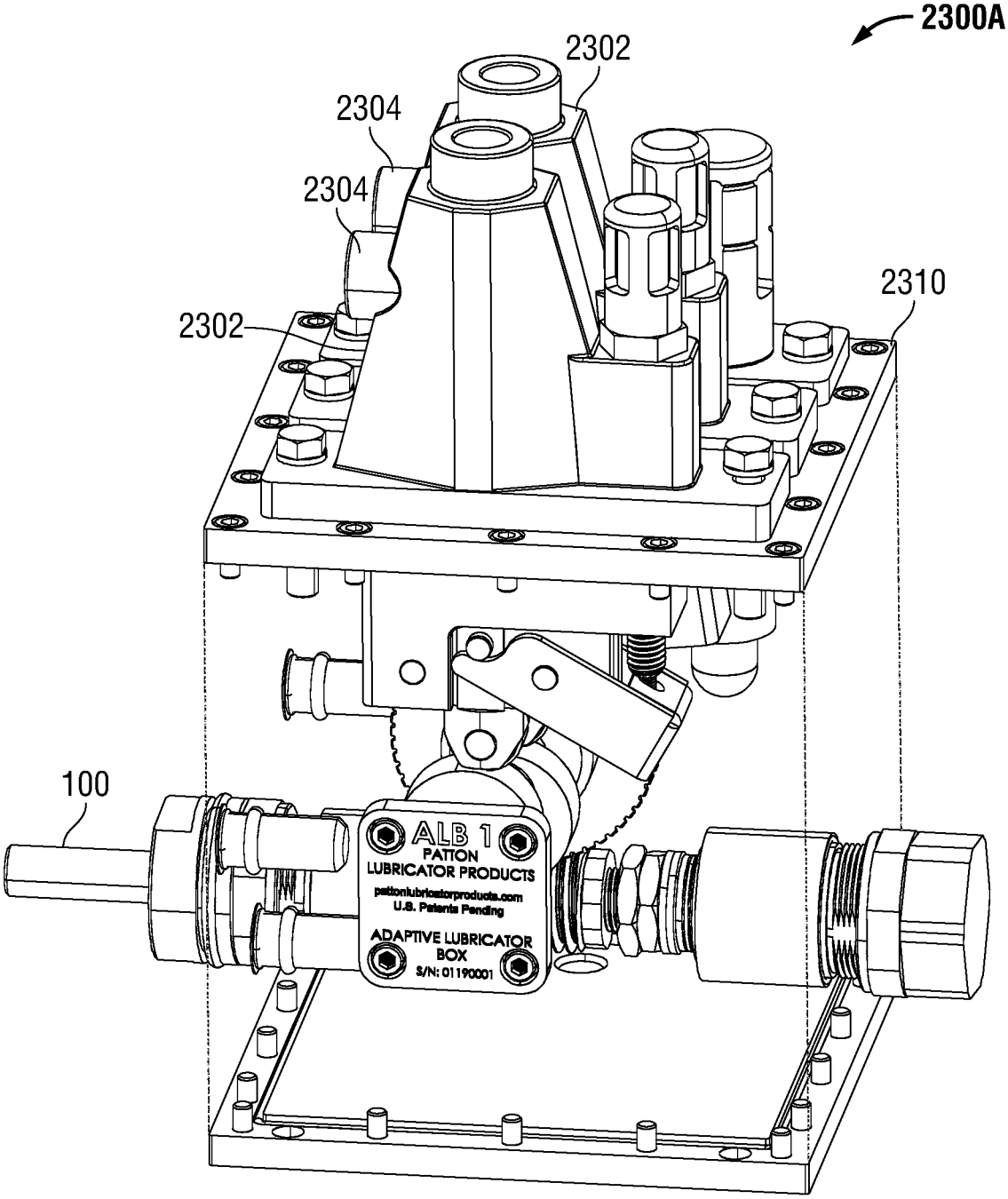
FIG. 23A shows a left-hand drive lube box and FIG. 23B shows a right-hand drive with a "rotated top plate;"
Figure 23B:
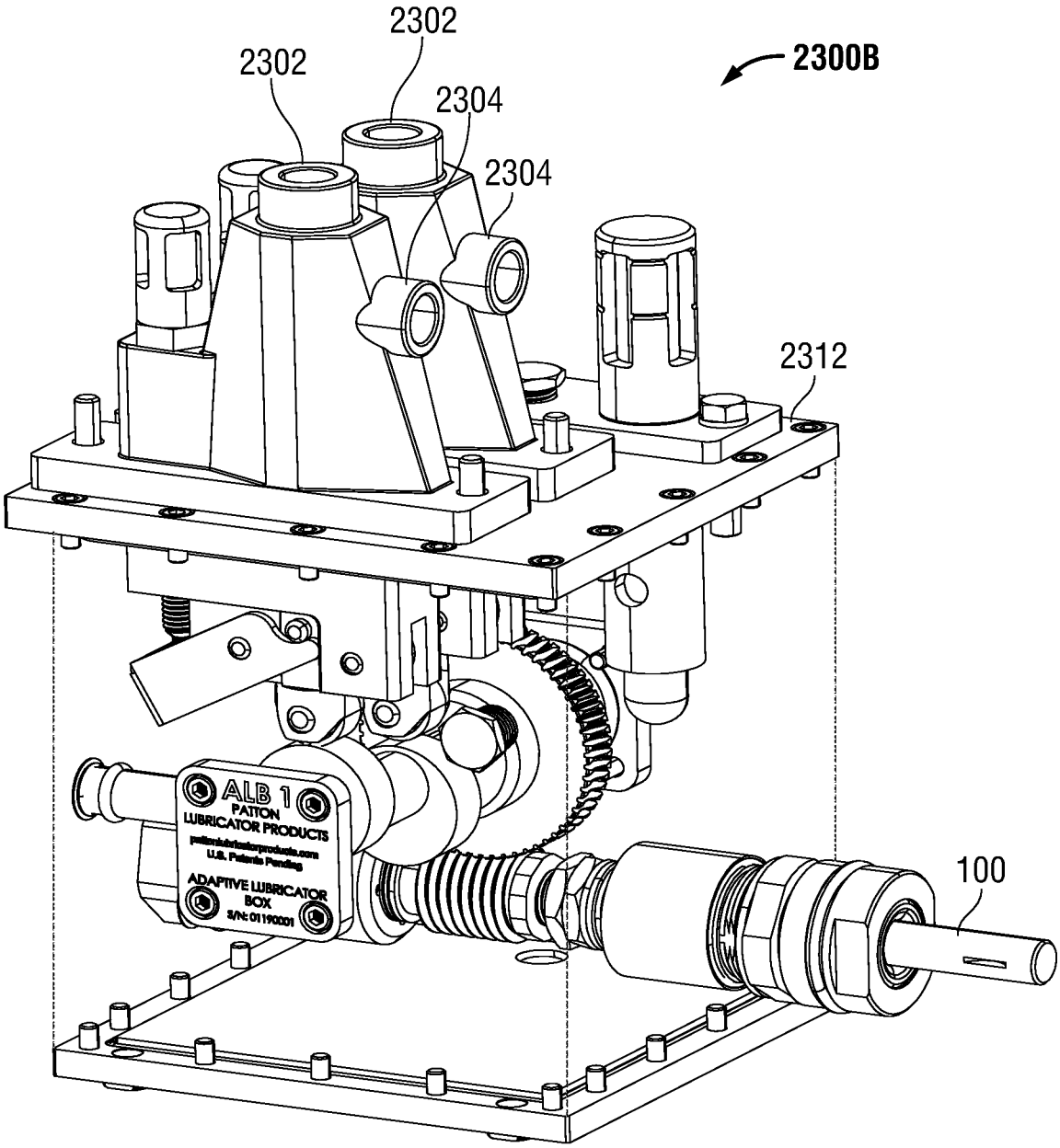

FIGS. 23A and 23B show lube boxes 2300*a* and 2300*b* in which the drive shafts extend from opposite sides. Two pumps 2302 are mounted on each of lube boxes 2300*a* and 2300*b*. Each pump has an outlet hole 2304. In operation, the outlet holes are connected to lubrication lines (not shown). If a lube box is turned 180 degrees so that the drive shaft extends from the side of the lube box facing the compressor, the direction of the pump outlets 2304 would also be reverses 180 degrees, which could make it difficult or impossible to connect the lubrication lines to the pumps. It may be necessary, therefore, to also turn the top plate 180 degrees to maintain the direction of the pump outlets when the lube box is rotated 180 degrees. Because the cams and therefore the pumps are typically not arranged symmetrically in the lube box, merely rotating the top plate 2310 180 degrees will cause a misalignment between the pumps and the cams.

In some embodiments, applicant provides a different top plate, referred to as a "rotated top plate" 2312, that can be used when the lube box is rotated 180 degrees relative to the compressor. The rotated top plate 2312 allows the pumps outlets to be maintained in their original direction when the lube box is rotated. A rotated top plate is not merely the same top plate rotated 180 degrees, but is a different top plate with mounting holes in different location from those in the non-rotated top plate 2310. The mounting holes that are used to mount the rotated top plate to the lube box are positioned so that the pump mount openings are aligned with the cams when the rotated top plate is mounted to the lube box. The rotated top plate 2312 will typically overhang the top of the lube box on one side, as shown in FIG. 23B. Using the rotated top plate 2312, the lube box can be rotated, and the pumps remain aligned with the cams, with the pump outlets pointed in the correct direction. FIG. 23A shows a left-hand drive lube box and FIG. 23B shows a right-hand drive with a "rotated top plate."

A shop therefore only needs to keep a rotated top plate in stock to allow the lube box to be used on compressors that require the drive shaft to extend from either side of the lube box. The ability to rotate the lube box, which is provided by the rotated top plate, allows the same lube box to be adapted to essentially any type of compressor, thereby greatly reducing the inventory of lube boxes required to be maintained by maintenance shops and reducing downtime caused by delays in replacing defective lube boxes.

To applicant's knowledge, no previous lube box has an engineered top cover available that enables the unit to be rotated 180 degrees and mounted on the compressor frame. Moreover, to applicant's knowledge, no previous lube box is designed to have the lubricator pump installed in a normal operating position or turned 180 degrees and installed in the opposite direction.

External Oil Level Indicator

Prior art lube boxes included a sight glass on the side of the lube box intended to provide a view into the lube box interior to show the oil level. Once the oil is dirty, however, the dirty oil coats the window of the sight glass, and a user cannot see the oil level within the lube box.

Figure 24B:
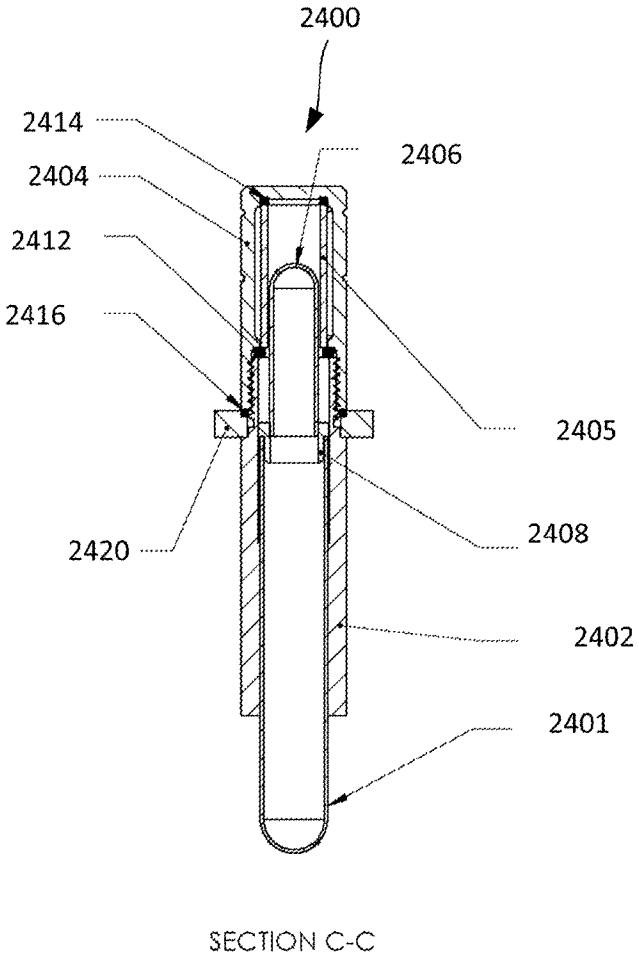
FIG. 24A shows an external oil level indicator and FIG. 24B is a cross section of the external oil level indicator of FIG. 14B.
Figure 24A:
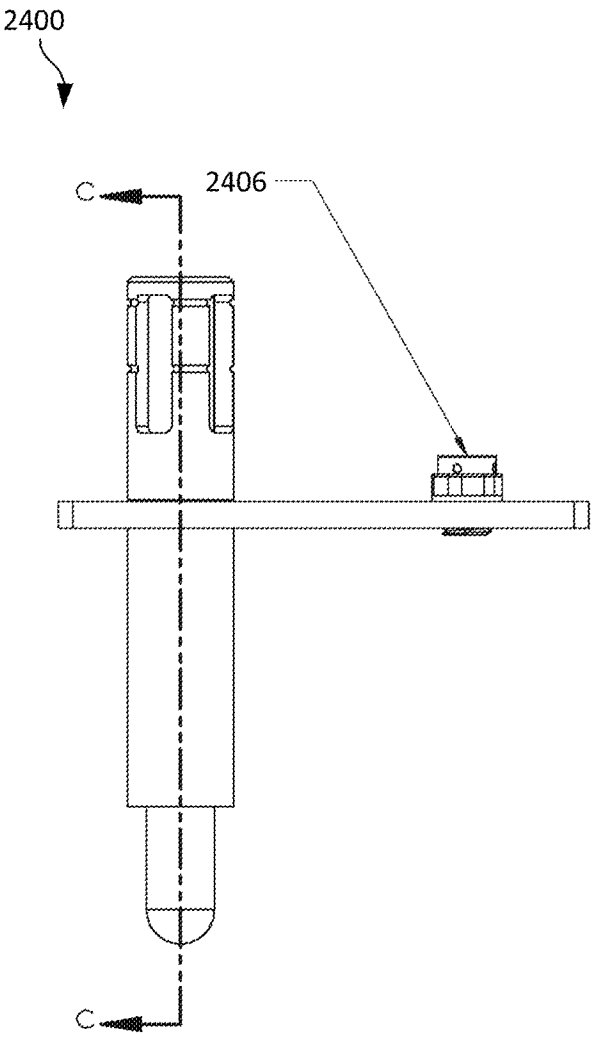

FIG. 24A shows an external oil level indicator 2400 that allows a user to view the level of oil in the lube box. FIG. 24B is a cross section of the external oil level indicator 2400 taken along line C-C of FIG. 24A. A float chamber 2401 extends into the oil within the lube box and is moveable within a float tube 2402. A top shroud 2404 protects a glass sleeve 2405 that surrounds a level indicator 2406 that is coupled to the float chamber 2402 by a float couple 2408. Oil is prevented from entering the glass sleeve 2405 by an O-ring 2414 at the top of the glass sleeve that seals between the glass sleeve and the top shroud, and by an O-ring 2412 that seals between the bottom the glass sleeve and a spacer 2422. By preventing oil from entering the glass sleeve, the oil level as indicated by the level indicator is never obscured by dirty oil. The float tube 2402 threads into the top shroud to compress an O-ring 2412 that seals the oil level indicator to a mounting plate 2420 to prevent lubricant from leaking into the environment.

The level indicator 2406 is preferably color coded to indicate whether the oil level is within an acceptable range, too high, or too low. For example, the top shroud of the glass sleeve may include markers and the level indicator may comprise multiple colors. The color of the level indicator within the markers on the top shroud may indicate the lubricant level. In one embodiment, a green color visible between the level indicators can indicate a lubrication level within the desired range, while a red color between the indicators may indicate an improper lubricant level, that is, too high or too low. Too low of an oil level can result in the compressor not receiving adequate lubricant and failing. Too high an oil level can result in excessive pressure within the system, which can cause failure of seals, resulting in leaks and loss of lubricant.

The external oil level indicator can be used on any lube box, and the lube boxes described above can be used with or without the external oil level indicator. The external oil level indicator is also visible in, for example, FIGS. 23A and 23B.

In prior art lube boxes, rising oil and atmospheric temperatures cause pressure inside the lubricator reservoir. Internal pressure increasing can cause shaft seals to fail and oil leaks from the lubricator reservoir. The rising pressure inside the lube box can also cause oil to leak to the atmosphere causing environmental issues. Low oil levels in the lube box cause gears and lube pumps to fail. FIG. 22 shows balancing relief valve 2208 that relieves internal pressure to protect the rotating shaft seals which eliminates gear failure caused by oil leaking from the lube box. The pressure balancing valve is a one-way valve and prevents water from entering the lubricator reservoir.

Lube Box Can be Repaired on the Compressor Frame On-Site, in the Field

The disclosed lube box is designed to enable the operator, mechanic, or field service person, to easily stock a few repair parts on their field truck which enables the operator or mechanic to repair of the ALB on-site. The ALB does not have to be removed from the compressor frame to be repaired. All internal components of the ALB can be replaced while the lube box remains mounted on the compressor frame. The three-part drive shaft allows the shaft to be disassembled, for example, to replace a worn worm gear. The cam shaft is removable and can be replaced with another cam shaft of the same size, or an extension cam shaft to add pumps.

Figure 25:
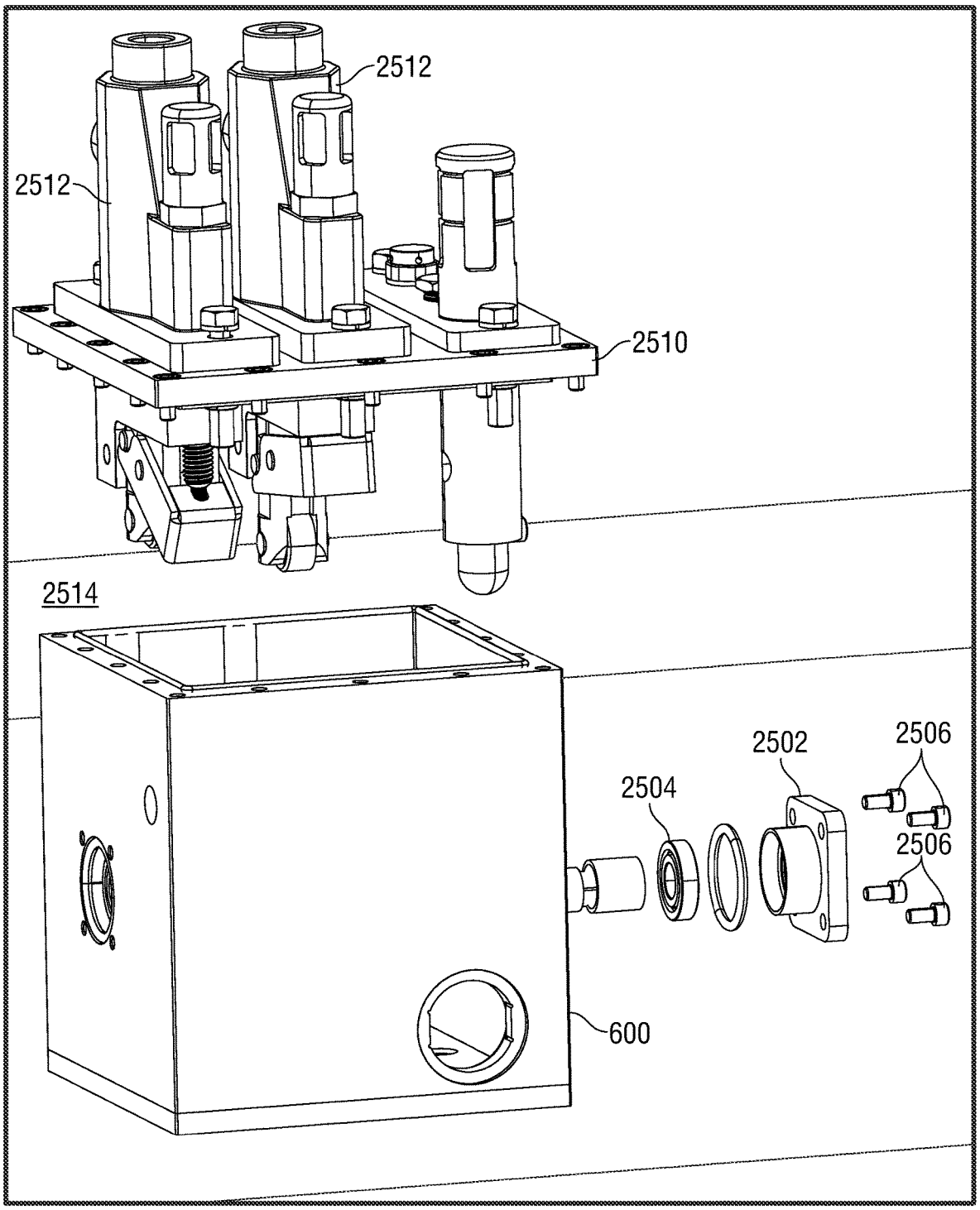
FIG. 25 shows a lube box attached to a compressor with the cam shaft and top plate with the pumps separated from the lube box.

FIG. 25 shows that cap 2502 and cam shaft bearings 2504 can be removed from the ends of the lube box 600by removing bolts 2506, allowing the cam shaft to be removed, even with the lube box remaining attached to the compressor. FIG. 25 also shows that the top plate 2510 and pumps 2512 can be removed while the lube box 600 remains mounted on the compressor 2514.

Sealed, Watertight Enclosure

The standard, prior art lube box currently available in the compressor industry is not waterproof. This is due to the way the components of the lube box are designed and type of gaskets used to seal the top cover of the lube box to the box itself.

The gaskets used to seal prior art lubricator pumps to the top of lube boxes do not form watertight seals and do not prevent water from entering the reservoir under heavy rainstorm conditions or high pressure washing, which is needed to clean the compressor frame. Water and debris contaminate the lubricating oil in the lube box which causes the components to wear and fail prematurely. The same debris in the lube box also causes the lubricator pumps to wear or fail prematurely.

Some embodiments of the disclosed lube box are engineered to be completely watertight. Embodiments described herein are designed with crushed O-Ring sealing surfaces, which create a watertight enclosure and eliminates the possibility of rainwater, high pressure water spray or contaminates from entering the lube box. This engineered design results in increased longevity of the internal components of all ALB lube boxes, which equates to reduced downtime of the compressor.

The preferred embodiment uses all blind fasteners and captive nuts are designed into the disclosed lube box to prevent water intrusion into the interior of the lube box.

Figure 26:
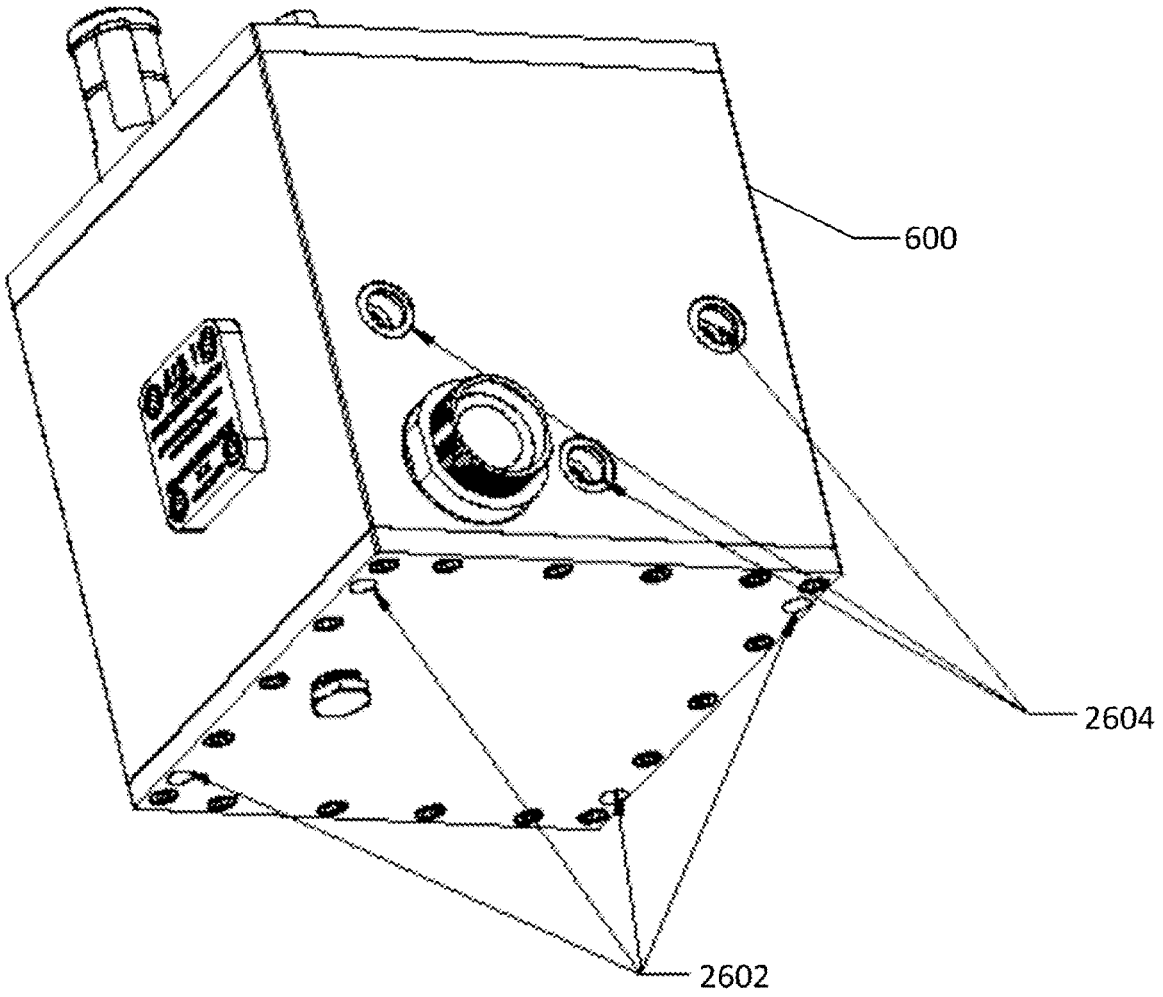
FIG. 26 shows a watertight lube box.

FIG. 26 shows a lube box 600 with watertight mounting holes 2602 for mounting the lube box onto an adapter plate and face-mounting holes 2604 with watertight blind captive fasteners.

Figure 27A:
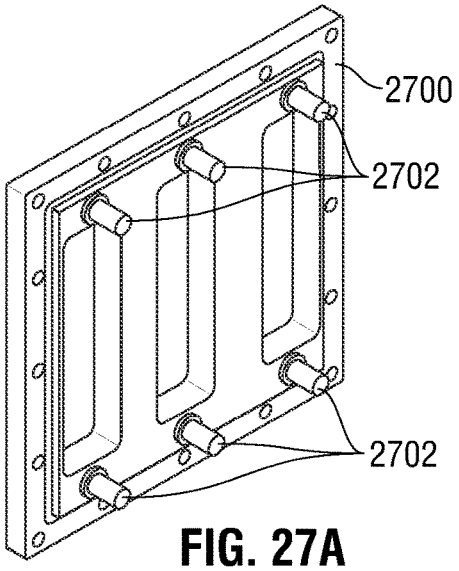
FIGS. 27*a*-27*d* shows multiple views of a top plate of a lube box.
Figure 27B:
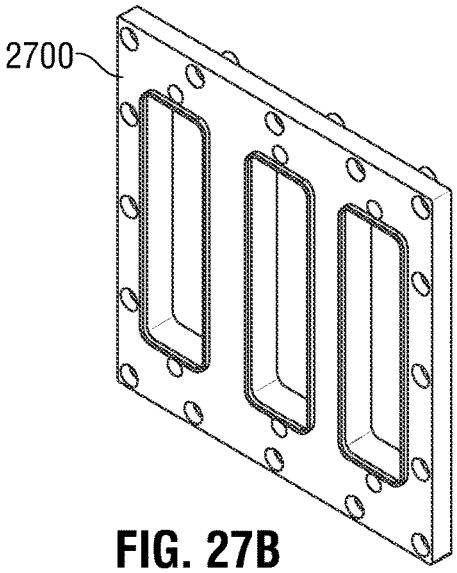
Figure 27C:
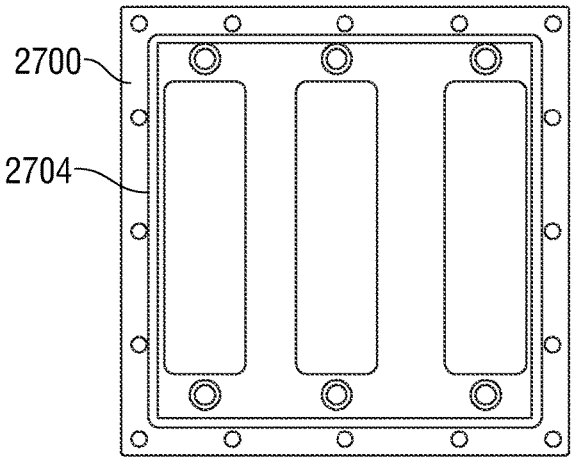
Figure 27D:
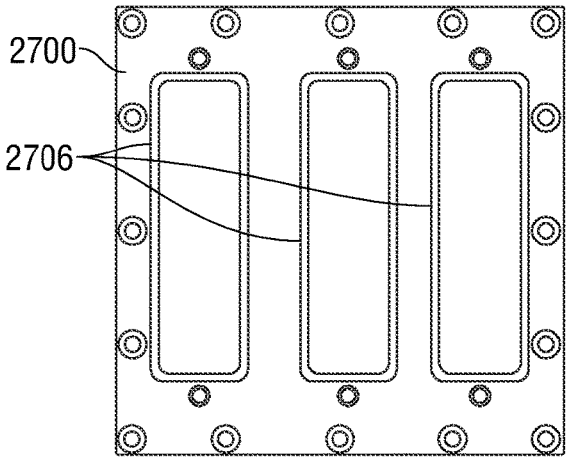

FIGS. 27*a*-27*d* shows multiple views of a top plate 2700 for a lube box. FIG. 27*a* is an isometric view of the underside of top plate 2700 showing watertight blind captive fasteners 2702. FIG. 27*b* is an isometric view of the top side of top plate 2700. FIG. 27*c* shows is a plan view of the underside of the top plate with an O-ring seal 2704 for sealing between the top plate and the lube box. FIG. 20*d* shows O-ring seals 2706 between the top plate and the pumps.

These specific engineered designs result in increased a completely waterproof box, which equates to the longevity of the internal components of all ALB-1 lube boxes, which reduces the downtime of the compressor.

Pumps

Figure 28:
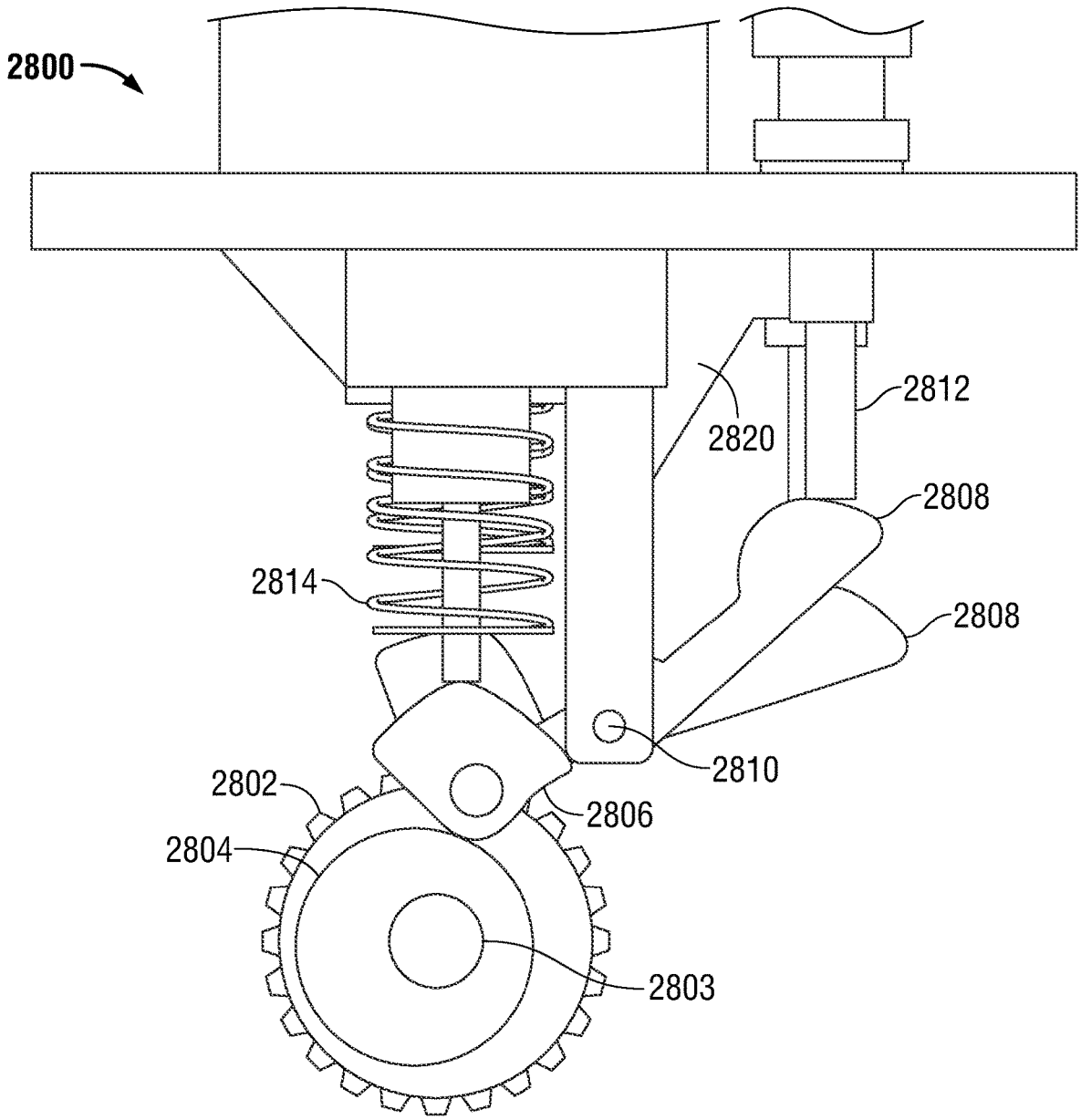
FIG. 28 shows a pump that is driven by a cam shaft inside a lube box.

FIG. 28 shows one embodiment of a pump that is driven by a cam shaft inside a lube box 2800. The invention is not limited to any particular type of pump mechanism. A gear 2802, is driven by a compressor driven shaft (not shown) and turn a lube box drive shaft 2803. Compressor driven drive shaft extends from and is driven by a compressor (not shown). The compressor driven drive shaft extends through a bushing or packing in the wall (not shown) of lube box 2800 adjacent the compressor. A cam 2804 on lube box drive shaft 2803 moves a cam follower 2806 that is part of a rocker arm 2808 (shown in two different positions) that pivots about an axis 2810 to drive a push rod 2812 up and down to power a pump (not shown) positioned above the lube box 2800. Spring 2814 keeps the cam follower 2806 in contact with am 2804. Bushing 2820 seals the push rod as it exits the lube box and enters the pump.

Figure 29:
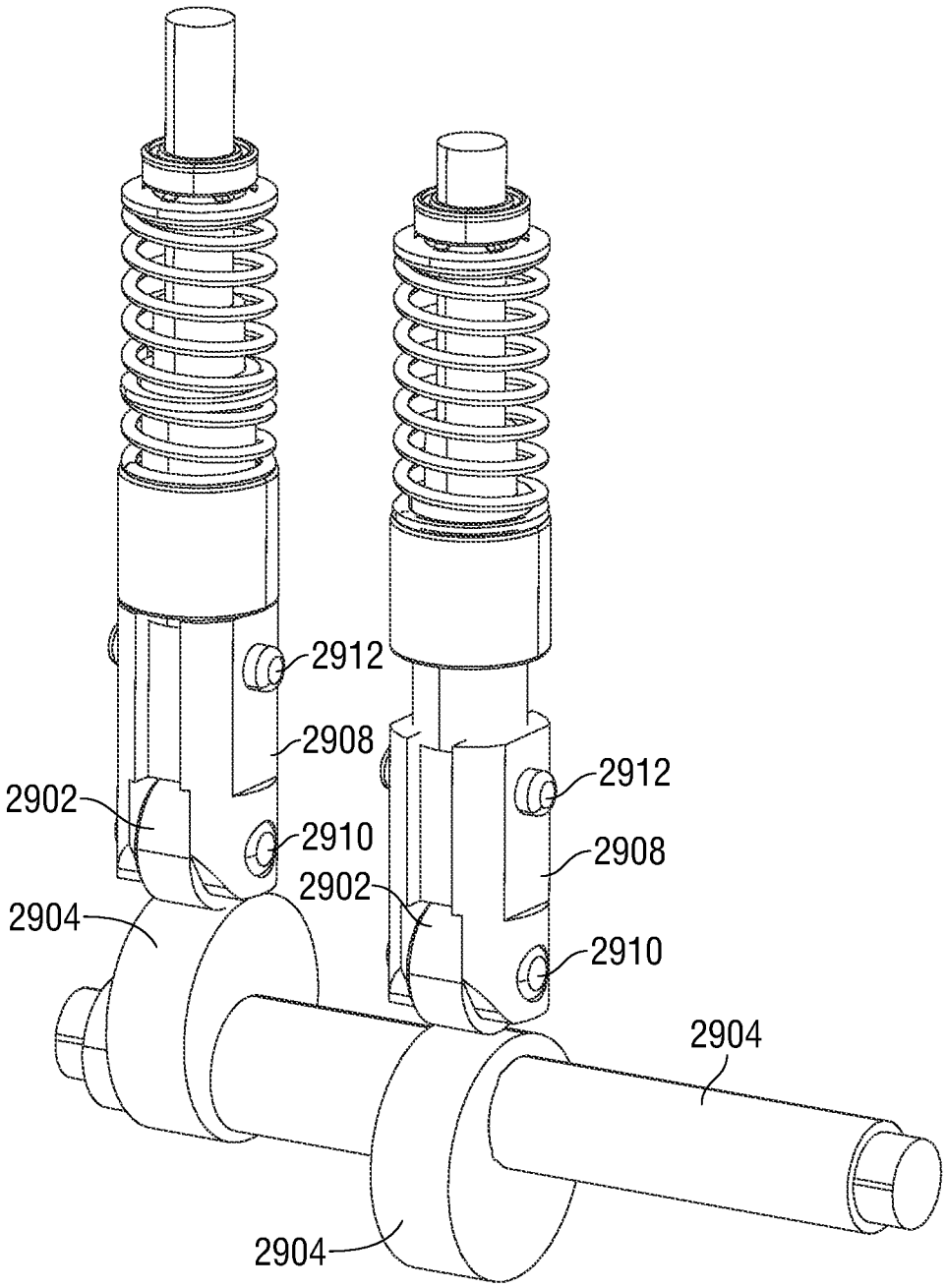
FIG. 29 shows a pump drive mechanism.
Figure 30:
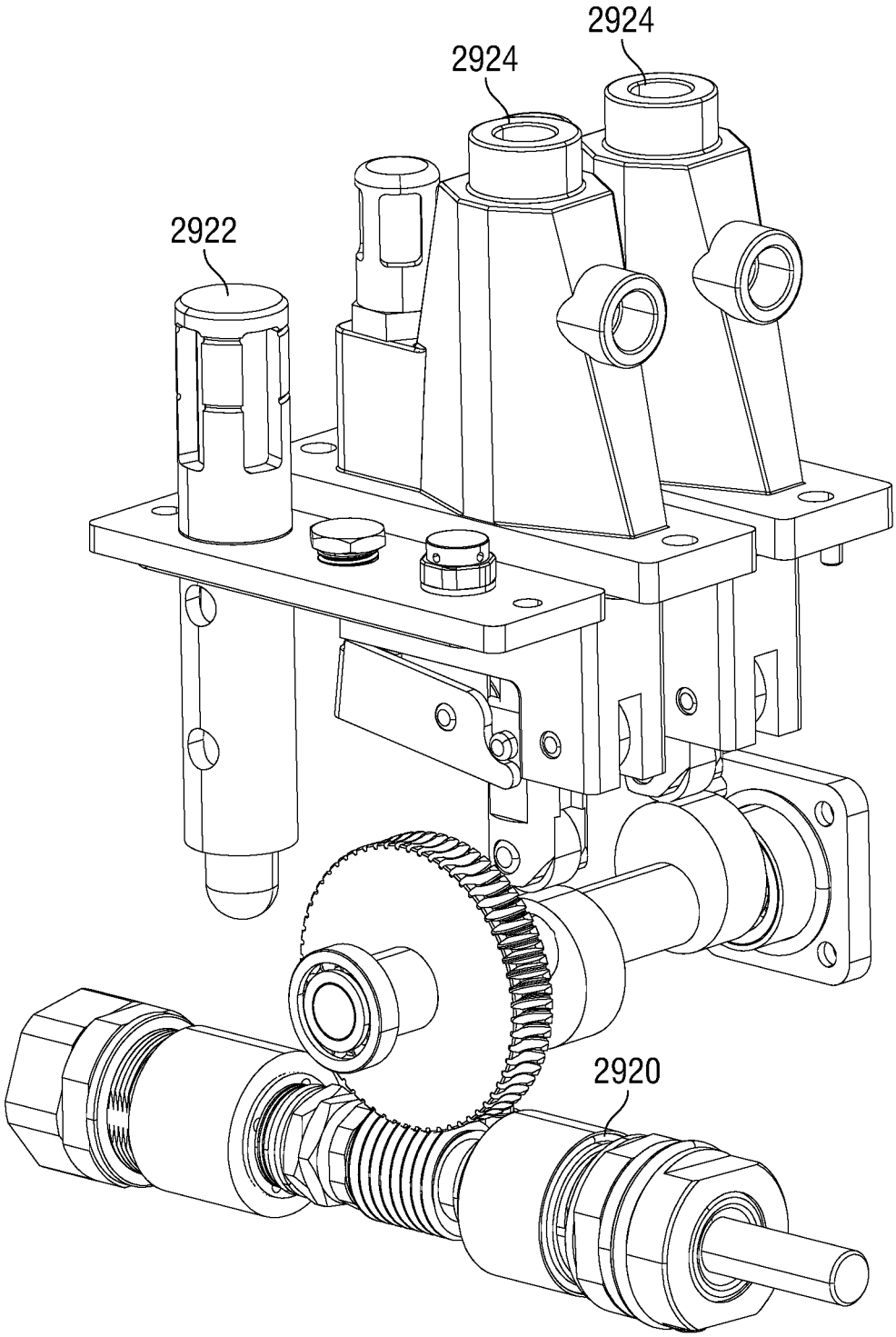
FIG. 30 shows a pump with the pump drive mechanism of FIG. 29.

FIGS. 29 and 30 show another type of pump drive mechanism. Rather than using conventional rocker arms like the prior art, the pump drive mechanism uses a roller 2902 2904 that rides directly on the cam 2904 and raises and lowers a push rod 2906 that activates the pump. A connector 2908 supports the roller on a pin 2910 and is secured to the push rod by a second pin 2912. FIG. 29 also shows the drive shaft 2920, the lubricant level indicator 2922 and the pumps 2924. Unlike prior art drive mechanism, in which the drive rods are offset from the cams, causing torque and uneven wear, the pump drive mechanism of FIGS. 28-30 reduces unsymmetrical forces on the drive mechanism, increasing its reliability.

The Adaptive Lube box incorporates a totally redesigned rotating drive assembly that allows an operator to add a through drive assembly to any ALB-1 lube box in a matter of minutes. This totally re-engineered rotating drive assembly gives the operator, mechanic, or product distributor the ability change drive assemblies on the lubricator reservoir to incorporate a through drive assembly that will enable the use of diagnostic equipment on all manufacturer's compressor frames. For example, an extended proximal segment 102*a* of drive shaft 100 can be used to extend through the lube box housing into the diagnostic equipment.

Figure 31:
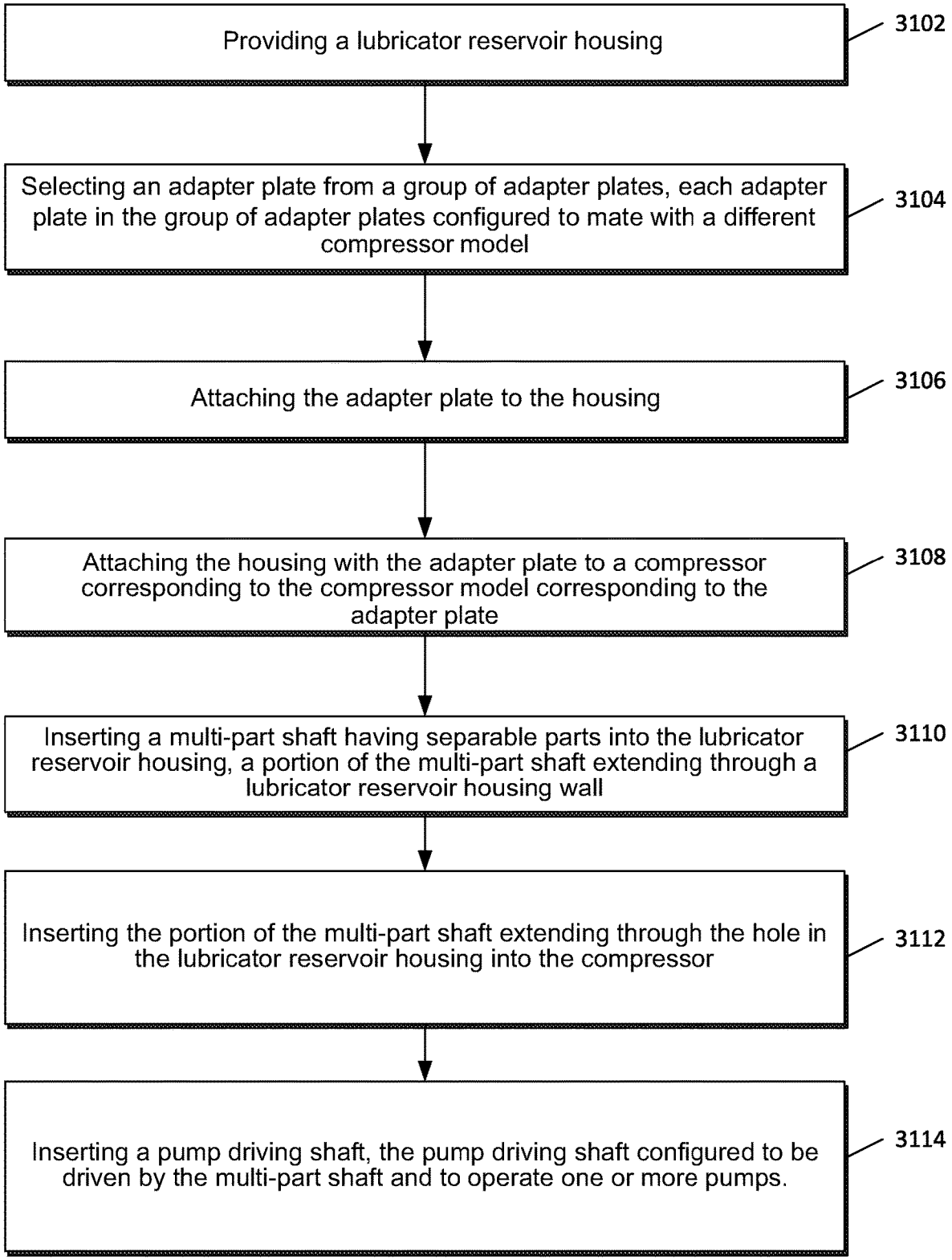
FIG. 31 is a flow chart showing a method of constructing a lubricator reservoir for use with a particular model of compressor

FIG. 31 is a flow chart showing a method of constructing a lubricator reservoir for use with a particular model of compressor. Step 3102 comprises providing a lubricator reservoir housing. Step 3104 comprises selecting an adapter plate from a group of adapter plates, each adapter plate in the group of adapter plates configured to mate with a different compressor model. Step 3106 comprises attaching the adapter plate to the housing. Step 3108 comprises attaching the housing with the adapter plate to a compressor corresponding to the compressor model corresponding to the adapter plate. Step 3110 comprises inserting a multi-part shaft having separable parts into the lubricator reservoir housing, a portion of the multi-part shaft extending through a lubricator reservoir housing wall. Step 3112 comprises inserting the portion of the multi-part shaft extending through the hole in the lubricator reservoir housing into the compressor. Step 3114 comprises inserting a pump driving shaft, the pump driving shaft configured to be driven by the multi-part shaft and to operate one or more pumps.

The steps of FIG. 31 do not need to be done in the order listed. For example, the multi-art drive shaft can be inserted into the housing prior to attaching the housing the compressor. The adapter plate can be attached to the compressor prior to the lube box housing being attached to the adapter plate. Optionally, spacers are inserted between the adapter plate and the compressor or between the adapter plate and the lube box.

Further disclosed is a lubricator reservoir kit, comprising a lubricator reservoir housing; multiple adapters, each adaptor configured to mount the lubricator reservoir housing to a different model of compressor; a multipart shaft having separable parts; a pump-driving shaft; multiple cams position able on the pump-driven shaft; multiple push rods, each configured to ride on one of the multiple cams; and a gear positionable on the pump driven shaft.

Although the present invention and its advantages have been described in detail, it should be understood that various changes, substitutions, and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

We claim as follows:

1. A lubrication reservoir, comprising:

a housing for containing a lubricating fluid;

a mounting adapter configured for mounting the housing onto a specific model of compressor, the mounting adapter being interchangeable with other mounting adapters configured to adapt the lubrication reservoir to mount onto different compressor models;

a drive shaft composed of multiple separable sections, the drive shaft including a first gear:

a cam shaft, including a second gear configured to be driven by the first gear; and multiple cams; and a cover plate for sealing the lubrication reservoir and having openings for mounting a lubrication pump.

2. The lubrication reservoir of claim 1, in which the drive shaft comprises three separable sections.

3. The lubrication reservoir of claim 1, in which the axis of the drive shaft is perpendicular to the axis of the cam shaft.

4. The lubrication reservoir of claim 1, in which one of the multiple separable sections of the drive shaft comprises a proximal section configured to mate with the specific model of compressor, the proximal section interchangeable with other proximal sections, the proximal section and each of the other proximal sections being configured to mate with a corresponding compressor model, and a center driven section on which is mounted a gear for driving the cam shaft.

5. The lubrication reservoir of claim 1, in which one of the multiple separable sections of the drive shaft comprises a distal section supported at a wall of the housing opposite of the wall closest to the compressor.

6. A lubrication reservoir, comprising:

a housing for containing a lubricating fluid;

a mounting adapter plate for mounting the housing onto a compressor;

a drive shaft composed of multiple separable sections, the drive shaft including a first gear:

a cam shaft, including a second gear configured to be driven by the first gear; and multiple cams; and a cover plate for sealing the lubrication reservoir and having openings for mounting a lubrication pump, and further comprising an extension housing, in which the housing includes a first opening for a portion of the drive shaft to connect to the compressor and a second opening through which the cam shaft extends into the extension housing.

7. The lubrication reservoir of claim 6, further comprising one or more additional extension housings.

8. The lubrication reservoir of claim 6, in which the mounting adapter is configured for mounting the lubrication reservoir onto the compressor and in which the mounting adapter is interchangeable with other mounting adapters so as to adapt the lubrication reservoir to mount onto different compressor models.

9. A lubrication reservoir comprising:

a housing for containing a lubricating fluid;

a mounting adapter plate configured for mounting the housing onto a specific model of compressor;

a drive shaft composed of multiple separable sections including a proximal section configured to mate with a compressor of a specific model and including a first gear:

a cam shaft, including a second gear configured to be driven by the first gear; and multiple cams; and a cover plate for sealing the lubrication reservoir and having openings for mounting a lubrication pump,;

wherein the proximal section and the mounting adapter being interchangeable with other proximal sections and mounting adapters so as to adapt the lubrication reservoir to be mountable onto different compressor models.

* * * * *